US009799314B2

(12) United States Patent
Lopiccolo et al.

(10) Patent No.: US 9,799,314 B2
(45) Date of Patent: Oct. 24, 2017

(54) DYNAMIC IMPROVISATIONAL FILL FEATURE

(71) Applicant: Harmonix Music Systems, Inc., Boston, MA (US)

(72) Inventors: Gregory B. Lopiccolo, Brookline, MA (US); Ryan Challinor, Cambridge, MA (US)

(73) Assignee: HARMONIX MUSIC SYSTEMS, INC., Boston, MA (US)

( * ) Notice: Subject to any disclaimer, the term of this patent is extended or adjusted under 35 U.S.C. 154(b) by 0 days.

(21) Appl. No.: 15/278,625

(22) Filed: Sep. 28, 2016

(65) Prior Publication Data

US 2017/0092254 A1 Mar. 30, 2017

Related U.S. Application Data

(60) Provisional application No. 62/233,701, filed on Sep. 28, 2015.

(51) Int. Cl.

| | |
|---|---|
| ***G10H 1/42*** | (2006.01) |
| ***G10H 1/36*** | (2006.01) |
| ***G10H 3/14*** | (2006.01) |

(52) U.S. Cl.

CPC ..... *G10H 1/42* (2013.01); *G10H 1/361* (2013.01); *G10H 3/146* (2013.01); (Continued)

(58) Field of Classification Search

CPC ..... G10H 1/42; G10H 1/361; G10H 3/146; G10H 2210/346; G10H 2220/135 (Continued)

(56) References Cited

U.S. PATENT DOCUMENTS

| | | | |
|---|---|---|---|
| 3,897,711 | A | 8/1975 | Elledge |
| 4,128,037 | A | 12/1978 | Montemurro |

(Continued)

FOREIGN PATENT DOCUMENTS

| | | | |
|---|---|---|---|
| DE | 19833989 | A1 | 2/2000 |
| EP | 1 029 566 | A2 | 8/2000 |

(Continued)

OTHER PUBLICATIONS

"Hf Transceiver and Receiver VFO Calibration: Methods #1 and #2", http://web.archive.org/web/20071119171602/http://www.hflink.com/calibration/, accessed May 21, 2012 (2 pages).

(Continued)

*Primary Examiner* — David Warren

(74) *Attorney, Agent, or Firm* — Wilmer Cutler Pickering Hale and Dorr LLP

(57) ABSTRACT

The present disclosure is directed at systems, methods, and apparatus for implementing a rhythm-action game having an improvisational fill feature. The rhythm-action game can provide a musical track having at least one section that can be varied. The rhythm-action game can also provide a database having a plurality of fills, wherein each fill includes a soundtrack and a set of cues. During run-time, the rhythm-action game can select, for each section in the musical track that can be varied, a fill from the plurality of fills. In some embodiments, this selection can be based on various characterizing parameters to ensure that the fill is a good fit for the musical track. The rhythm-action game can also display a set of visual cues associated with the selected fill, and to evaluate whether received user input substantially corresponds to the displayed cues.

21 Claims, 9 Drawing Sheets

(52) U.S. Cl.
CPC . *G10H 2210/346* (2013.01); *G10H 2210/361* (2013.01); *G10H 2220/135* (2013.01); *G10H 2230/281* (2013.01)

(58) Field of Classification Search
USPC ..... 84/311
See application file for complete search history.

(56) References Cited

U.S. PATENT DOCUMENTS 4,295,406 A 10/1981 Smith
4,794,838 A 1/1989 Corrigau, III
5,109,482 A 4/1992 Bohrman
5,140,889 A 8/1992 Segan et al.
5,393,926 A 2/1995 Johnson
5,469,370 A 11/1995 Ostrover et al.
5,510,573 A 4/1996 Cho et al.
5,513,129 A 4/1996 Bolas et al.
5,557,057 A 9/1996 Starr
5,739,457 A * 4/1998 Devecka ..... A63F 13/005 434/307 A
5,777,251 A 7/1998 Hotta et al.
6,075,197 A 6/2000 Chan
6,111,179 A 8/2000 Miller
6,162,981 A 12/2000 Newcomer et al.
6,225,547 B1 5/2001 Toyama et al.
6,252,153 B1 6/2001 Toyama
6,268,557 B1 7/2001 Devecka
6,342,665 B1 1/2002 Okita et al.
6,347,998 B1 2/2002 Yoshitomi et al.
6,369,313 B2 * 4/2002 Devecka ..... A63F 13/005 434/307 A
6,379,244 B1 4/2002 Sagawa et al.
6,390,923 B1 5/2002 Yoshitomi et al.
6,410,835 B2 6/2002 Suzuki et al.
6,425,822 B1 7/2002 Hayashida et al.
6,438,611 B1 8/2002 Hara et al.
6,461,239 B1 10/2002 Sagawa et al.
6,482,087 B1 11/2002 Egozy et al.
6,483,018 B2 11/2002 Mead
6,541,692 B2 4/2003 Miller
6,555,737 B2 4/2003 Miyaki et al.
6,645,067 B1 11/2003 Okita et al.
6,653,545 B2 11/2003 Redmann et al.
6,663,491 B2 12/2003 Watabe et al.
6,685,480 B2 2/2004 Nishimoto et al.
6,699,123 B2 3/2004 Matsuura et al.
6,835,887 B2 12/2004 Devecka
6,850,252 B1 2/2005 Hoffberg
6,905,413 B1 6/2005 Terao et al.
6,924,425 B2 8/2005 Naples et al.
6,936,758 B2 8/2005 Itoh
6,987,221 B2 1/2006 Platt
7,078,607 B2 7/2006 Alferness
7,083,519 B2 8/2006 Toyoshima
7,164,076 B2 1/2007 McHale et al.
7,208,672 B2 4/2007 Camiel
7,220,910 B2 5/2007 Plastina et al.
7,223,913 B2 5/2007 Knapp et al.
7,232,949 B2 6/2007 Hruska et al.
7,320,643 B1 1/2008 Brosius et al.
D569,382 S 5/2008 Yow et al.
7,459,324 B1 12/2008 Ptasinski et al.
7,459,624 B2 12/2008 Schmidt et al.
7,525,036 B2 4/2009 Shotwell et al.
7,559,834 B1 7/2009 York
7,789,741 B1 9/2010 Fields et al.
7,840,288 B2 11/2010 Graepel et al.
7,855,333 B2 12/2010 Miyajima et al.
7,855,334 B2 12/2010 Yamashita et al.
7,935,880 B2 5/2011 Stoddard et al.
7,982,114 B2 * 7/2011 Applewhite ..... G10H 1/0058 84/477 R
8,003,872 B2 8/2011 Lopiccolo et al.
8,026,435 B2 * 9/2011 Stoddard ..... G10H 1/368 434/307 A
8,076,574 B2 12/2011 Irmer et al.
8,173,883 B2 5/2012 Willacy et al.
8,198,526 B2 6/2012 Lzen et al.
8,324,494 B1 * 12/2012 Packouz ..... G10H 1/0066 84/635
8,449,360 B2 * 5/2013 Stoddard ..... A63F 13/814 463/34
8,663,013 B2 * 3/2014 Egozy ..... A63F 13/005 463/35
8,690,670 B2 4/2014 Kay et al.
8,847,053 B2 * 9/2014 Humphrey ..... G09B 5/065 434/308
9,033,795 B2 * 5/2015 Yum ..... A63F 13/06 463/31
9,324,216 B2 * 4/2016 Janosov ..... G07F 17/34
2002/0002900 A1 1/2002 Cho
2002/0025842 A1 2/2002 Nobe et al.
2002/0032054 A1 3/2002 Hosoya
2002/0088337 A1 7/2002 Devecka
2002/0128736 A1 9/2002 Yoshida et al.
2002/0142818 A1 10/2002 Nakatsuka et al.
2002/0160824 A1 10/2002 Goto et al.
2002/0169014 A1 11/2002 Egozy et al.
2003/0014262 A1 1/2003 Kim
2003/0083130 A1 5/2003 Toyoshima
2003/0164084 A1 9/2003 Redmann et al.
2004/0132518 A1 7/2004 Uehara et al.
2004/0148159 A1 7/2004 Crockett et al.
2004/0229685 A1 11/2004 Smith et al.
2004/0244566 A1 12/2004 Steiger
2005/0070359 A1 3/2005 Rodriquez et al.
2005/0101364 A1 5/2005 Onoda et al.
2005/0120865 A1 6/2005 Tada
2005/0235809 A1 10/2005 Kageyama
2005/0255914 A1 11/2005 McHale et al.
2005/0273319 A1 12/2005 Dittmar et al.
2006/0058101 A1 3/2006 Rigopulos
2006/0127053 A1 6/2006 Lee
2006/0191401 A1 8/2006 Ueshima et al.
2006/0205506 A1 9/2006 Toyoshima
2006/0258450 A1 11/2006 Ishihata et al.
2006/0266200 A1 11/2006 Goodwin
2006/0287106 A1 12/2006 Jensen
2006/0290810 A1 12/2006 Mallinson
2007/0015571 A1 1/2007 Walker et al.
2007/0059670 A1 3/2007 Yates
2007/0081562 A1 4/2007 Ma
2007/0087835 A1 4/2007 Van Luchene
2007/0111802 A1 5/2007 Ishihara et al.
2007/0140510 A1 6/2007 Redmann
2007/0163427 A1 7/2007 Rigopulos et al.
2007/0163428 A1 7/2007 Salter
2007/0232374 A1 10/2007 Lopiccolo et al.
2007/0234881 A1 10/2007 Takehisa
2007/0234885 A1 10/2007 Schmidt et al.
2007/0243915 A1 10/2007 Egozy et al.
2007/0245881 A1 10/2007 Egozy et al.
2008/0009346 A1 1/2008 Jessop et al.
2008/0076497 A1 3/2008 Kiskis et al.
2008/0102958 A1 5/2008 Kitamura et al.
2008/0113698 A1 5/2008 Egozy
2008/0200224 A1 8/2008 Parks
2008/0220864 A1 9/2008 Brosius et al.
2008/0255914 A1 10/2008 Oren et al.
2008/0268943 A1 10/2008 Jacob
2008/0280680 A1 11/2008 Dutilly et al.
2008/0311969 A1 * 12/2008 Kay ..... A63F 13/10 463/7
2008/0311970 A1 12/2008 Kay et al.
2009/0075711 A1 3/2009 Brosius et al.
2009/0088249 A1 4/2009 Kay et al.
2009/0104956 A1 4/2009 Kay et al.
2009/0107320 A1 4/2009 Willacy et al.
2009/0258686 A1 10/2009 McCauley et al.
2010/0009749 A1 * 1/2010 Chrzanowski, Jr. .... A63F 13/10 463/35

(56) References Cited

U.S. PATENT DOCUMENTS

| | | | | |
|---|---|---|---|---|
| 2010/0016079 | A1 | 1/2010 | Jessop | |
| 2010/0029386 | A1* | 2/2010 | Pitsch | A63F 13/12 463/35 |
| 2010/0041477 | A1 | 2/2010 | Kay et al. | |
| 2010/0137049 | A1 | 6/2010 | Epstein | |
| 2010/0300264 | A1* | 12/2010 | Foster | G10H 1/0058 84/610 |
| 2010/0300265 | A1* | 12/2010 | Foster | G10H 1/0016 84/610 |
| 2010/0300266 | A1* | 12/2010 | Stoddard | G10H 1/368 84/610 |
| 2010/0300268 | A1* | 12/2010 | Applewhite | G10H 1/368 84/610 |
| 2010/0300269 | A1* | 12/2010 | Applewhite | G10H 1/0058 84/610 |
| 2010/0300270 | A1 | 12/2010 | Applewhite et al. | |
| 2010/0304810 | A1* | 12/2010 | Stoddard | G10H 1/368 463/7 |
| 2010/0304811 | A1 | 12/2010 | Schmidt et al. | |
| 2010/0304863 | A1* | 12/2010 | Applewhite | G10H 1/368 463/36 |
| 2010/0307321 | A1 | 12/2010 | Mann et al. | |
| 2010/0319517 | A1 | 12/2010 | Savo et al. | |
| 2011/0028214 | A1 | 2/2011 | Bright et al. | |
| 2011/0251840 | A1 | 10/2011 | Cook et al. | |
| 2011/0306397 | A1 | 12/2011 | Fleming et al. | |
| 2015/0161978 | A1* | 6/2015 | Packouz | G10H 1/40 84/746 |
| 2016/0240179 | A1* | 8/2016 | Uemura | G10H 7/02 |
| 2016/0343362 | A1* | 11/2016 | Brosius | G10H 1/0016 |
| 2017/0025107 | A1* | 1/2017 | Packouz | G10H 1/348 |
| 2017/0025108 | A1* | 1/2017 | Packouz | G10H 1/42 |

FOREIGN PATENT DOCUMENTS

| | | | |
|---|---|---|---|
| EP | 1 081 680 | A1 | 3/2001 |
| EP | 1 096 468 | A2 | 5/2001 |
| EP | 1 145 749 | A2 | 10/2001 |
| EP | 1 825 896 | A1 | 8/2007 |
| JP | 2000288254 | | 10/2000 |
| JP | 2001075579 | | 3/2001 |
| WO | WO-8601927 | A1 | 3/1986 |
| WO | WO-2004008430 | A1 | 1/2004 |
| WO | WO-2007055522 | A1 | 5/2007 |
| WO | WO-2007115072 | A1 | 10/2007 |
| WO | WO-2007115299 | A2 | 10/2007 |

OTHER PUBLICATIONS

Association of British Scrabble Players, "Rolling System", ABSP, URL<http://www.absp.org.uk/results/ratings_detail.shtml>, accessed May 25, 2011 (4 pages).

Audio Grafitti: "Audio Graffiti: Guide to Drum & Percussion Notation", URL:http://web/mit.edu/merolish/Public/drums.pdf, Aug. 2004 (4 pages).

Dance Dance Revolution Max, Game Manual, Konami Corporation, released in the US on Oct. 29, 2009 (2 pages).

Definition of "Magnitude", Google.com, https://www.google.com/search?q=define%3Amagnitude&sugexp=chrome,mod=1 &sourceid=chro me . . ., retrieved Aug. 16, 2012 (2 pages).

European Extended Search Report issued in EP16170347.5, dated Sep. 23, 2016 (8 pages).

GamesRadar Guitar Hero Summary, http://www.web.archive.org/web/20080212013350/http://www.gamesradar.com/ps2/ . . ./g-200512169201488 3026, accessed Jul. 8, 2012 (3 pages).

Guitar Hero (video game)—Wikipedia, the free encyclopedia, Release Date Nov. 2005, http://en.wikipedia.org/w/index.php?title=guitary_hero&oldid=137778068, accessed May 22, 2012 (5 pages).

Guitar Hero—Wikipedia, the free encyclopedia - Released Nov. 8, 2005, http://en.wikipedia.org/wiki/Guitar_Hero_(series), accessed Mar. 20, 2009 (25 pages).

Guitar Hero Review by Misfit119, Retrieved 2 Jan. 2010. http://www.gamefaqs.com/console/ps2/review/R110925.html (1 page).

Guitar Hero Review by Ninjujitsu. Retrieved Jan. 2, 2010. http://www.gamefaqs.com/console/ps2/review/R94093.html (1 page).

Guitar Hero Review by SaxMyster. Retrieved Jan. 2, 2010, http://www.gamefaqs.com/console/ps2/review/R109815.html (1 page).

Guitar Hero Reviewed by T. Prime, http://www.gamefaqs.com/console/ps2/review/R113400.html, accessed Jan. 2, 2010 (2 pages).

GuitarFreaks—Wikipedia, the free encyclopedia—(Publisher—Konami, Konami Digital Entertainment) Release Date 1998, http://en/wikipedia.org/wiki/GuitarFreaks,http://en.wikipedia.org/wiki/List_of GuitarFreaks_and_Drummania_Games, accessed Mar. 19, 2009 (5 pahes).

Index of /Partitions, entersandman.com, http://web.archive.org/web/20061021231758/http://batterieandcosite.free.fr/Partitions, pp. 1, 22, and 36 accessed Oct. 2, 2008 (3 pages).

Lohman, T., "Rockstar vs Guitar Hero", UNLV: The Rebel Yell—Nov. 13, 2008, http://unlvrebelyell.com/2008/11/13/rockstar-vs-guitar-hero/, accessed Mar. 19, 2009 (5 pages).

Nakano, T., et al., "Voice Drummer: A Music Notation Interface of Drum Sounds Using Voice Percussion Input", UIST '05—Adjunct Proceedings of the 18th Annual ACM Symposium on User Interface Software and Technology, Oct. 23-27, 2005, Seattle, WA, USA (2 pages).

NCSX.Com: Game Synopsys of Guitar Freaks & DrumMania Masterpiece Gold, with a date of Mar. 8, 2007, and with an Archive.org Wayback Machine verified date of May 17, 2007, downloaded from http://web.archive.org/web/20070517210234/http://www. ncsx.com/2007/030507/guitarfreaks_gold.htm, National Console Support, Inc., accessed Jun. 7, 2011 (4 pages).

Ramsey, Aaron, GuitarFreaks & DrumMania Masterpiece Gold Faq v1.04, with a revision date of Apr. 2, 2007, and with an Archive.org Wayback Machine verified date of Apr. 22, 2007, downloaded from http://web/archive.org/web/20070422184212/http://www.gamefaqs.com/console/ps2/file/9 . . ., accessed Jun. 10, 2011 (52 pages).

RedOctane. "Guitar Hero II Manual", game manual, Activision Publishing, Inc., 2006 (13 pages).

Rock Band (video game), Wikipedia, the free encyclopedia, http://en.wikipedia.org/wiki/Rock_Band_(video_game), accessed Jul. 26, 2011 (29 pages).

Rock Band Wii Instructional Booklet, Harmonix Music Systems, Inc., 2008 (15 pages).

Sheet Music: "Enter Sandman", by Metallica, URL:http://batterieandcosite.free.fr/Partitions/entersandman.pdf (4 pages).

Taiko Drum Master Instruction Manual, NAMCO, 2004 (18 pages).

Virginia Tech Multimedia Music Dictionary: "P: Phrase", Virginia Tech University URL:<http://www.music.vt.edu/musicdictionary/textp/Phrase.html>, accessed May 25, 2011 (7 pages).

* cited by examiner

| Drum fill ID 752 | Length 754 | Style 756 | Tempo 758 | Beat type 760 | Difficulty 762 |
|---|---|---|---|---|---|
| 1 | 2 bars | Rock | Fast | Triplets | Expert |
| 2 | 2 bars | Jazz | Medium | Swung | Hard |
| 3 | 1 bar | Country | Fast | Straight | Medium |
| 4 | 2 bars | Blues | Slow | Straight | Easy |

DYNAMIC IMPROVISATIONAL FILL FEATURE

RELATED APPLICATIONS

This application claims benefit under 35 U.S.C. §119(e) of U.S. Provisional Patent Application No. 62/233,701, filed Sep. 28, 2015, entitled "Dynamic Improvisational Fill Feature," the content of which is incorporated by reference in its entirety.

FIELD OF THE INVENTION

The present invention relates to rhythm-action games, and, more specifically, video games which simulate the experience of playing in a band.

BACKGROUND

Music making is often a collaborative effort among many musicians who interact with each other. One form of musical interaction may be provided by a video game genre known as "rhythm-action," which involves a player performing phrases from a pre-recorded musical composition using a video game's input device to simulate a musical performance. If the player performs a sufficient percentage of the notes or cues displayed, he may score well and win the game. If the player fails to perform a sufficient percentage, he may score poorly and lose the game. Two or more players may compete against each other, such as by each one attempting to play back different, parallel musical phrases from the same song simultaneously, by playing alternating musical phrases from a song, or by playing similar phrases simultaneously. The player who plays the highest percentage of notes correctly may achieve the highest score and win. Two or more players may also play with each other cooperatively. In this mode, players may work together to play a song, such as by playing different parts of a song, either on similar or dissimilar instruments. One example of a rhythm-action game is the ROCK BAND™ series of games developed by Harmonix Music Systems, Inc. Another example of a rhythm-action game is the KARAOKE REVOLUTION series of games published by Konami.

Past rhythm-action games that have been released for home consoles have utilized a variety of controller types. For example, GUITAR HERO II, published by Red Octane, could be played with a simulated guitar controller or with a standard game console controller.

A rhythm-action game may require a number of inputs to be manipulated by a player simultaneously and in succession. Past rhythm-action games have utilized lanes divided into sub-lanes to indicate actions. In these games, a lane is divided into a number of distinct sub-lanes, with each sub-lane corresponding to a different input element. For example, a lane for a player might be divided into five sub-lanes, with each sub-lane containing cues corresponding to a different one of five fret buttons on a simulated guitar. As cues appear in each of the sub-lanes, a player must press the appropriate corresponding fret button.

In some cases, the sub-lanes are laid out to correspond to a linear set of input elements. For example, a lane may be divided into five sub-lanes, each sub-lane containing red cues, green cues, yellow cues, blue cues and orange cues, respectively, to correspond to a guitar having a linear arrangement of a red button, green button, yellow button, blue button and orange button. Displaying cues may be more challenging in instances where input elements are not linearly arranged. For example, in the DRUMMANIA series of games published by Konami, players provide input via a number of drum pads and a foot pedal. Foot pedal actions were signified by a sub-lane containing cues shaped like feet.

In some single-player rhythm-action games, such as the GUITAR HERO series, it is possible for a player to "fail" midway through a song. That is, if the player's performance falls below a given threshold, the player may be prevented from completing the song. Such a failure may be accompanied by sounds of the music stopping, the crowd booing, and images of the band stopping the performance. This possibility of failure may enhance a game by providing more serious consequences for poor performance than simply a lower score: if a player wants to complete a song to the end, the player must satisfy a minimum standard of performance. Adapting this failure mechanic to a multiplayer game presents a challenge, as the enhanced incentives for good performance may be desired, but it may be undesirable for one player to remain inactive for long periods of time while others are playing a song.

SUMMARY OF THE INVENTION

The techniques described herein are directed at a dynamic fill feature for a rhythm-action game. In some embodiments, this dynamic fill feature can be implemented using a simulated drum controller. It is an object of the presently disclosed fill feature to emulate the fill improvisation exhibited by real drummers. The presently disclosed feature can also present non-drummers with a skill- and style-appropriate set of fills to perform at appropriate sections of songs. Furthermore, the presently disclosed fill feature can vary the play experience of a player even when playing the same song multiple times.

In one aspect, the present disclosure is directed at a computer system for varying a play experience of a player of a rhythm-action game. The system can comprise a game console having a memory that stores a musical track, the musical track having at least one variable fill section. The memory can also store a database having a plurality of fills for the at least one variable fill section, each fill being associated with a different set of cues, wherein each cue directs the player to provide an input. The system can also comprise at least one processor configured to, for each variable fill section of the at least one variable fill section in the musical track: (i) select, for a playthrough of the musical track a fill from the plurality of fills in the database, (ii) transmit display data to a display, the display data comprising at least part of the set of cues associated with the selected fill, and (iii) for each displayed cue: (a) receive player input, (b) evaluate whether the received player input corresponds to the input directed by the displayed cue, and (c) alter an aspect of gameplay based on the evaluation.

In some embodiments, the processor can be configured to mute or distort the soundtrack associated with the corresponding selected fill when the user input does not correspond to the displayed set of cues. For example, each fill of the plurality of fills in the database can be further associated with a different soundtrack. The at least one processor can be further configured to alter an aspect of gameplay based on the evaluation by: (i) when the received user input corresponds to the input directed by the displayed cue, playing at least a portion of the soundtrack associated with the fill that is associated with the set of cues of which the displayed cue is a part, and (ii) when the received user input does not correspond to the input directed by the displayed cue, playing at least one of a muffled, muted, or distorted version of the soundtrack associated with the fill that is associated with the set of cues of which the displayed cue is a part.

In some embodiments, the user input can be received via a simulated drum controller, and the plurality of fills can comprise a plurality of drum fills. For example, each cue can direct the player to provide an input corresponding to a drum pad of a plurality of drum pads on a drum controller. The at least one processor can be further configured to receive player input by receiving input from the drum controller indicating which drum pad on the drum controller has been activated. The at least one processor can be further configured to evaluate whether the received player input corresponds to the input directed by the displayed cue by evaluating whether the activated drum pad corresponds to the drum pad directed by the displayed cue.

In some embodiments, each soundtrack associated with each fill of the plurality of fills can be played according to a plurality of synthesizer settings. The at least one processor can be further configured to play at least a portion of the soundtrack when the received user input corresponds to the input directed by the displayed cue by: selecting a synthesizer setting, and playing the at least a portion of the soundtrack using the selected synthesizer setting.

In some embodiments, the selection of the synthesizer setting is based at least in part on at least one characterizing parameter associated with at least one of the musical track, a variable fill section of the musical track, and a fill section selected by the processor.

In some embodiments, the playthrough is a first playthrough, and the at least one processor can be further configured to: for each variable fill section of the at least one variable fill section in the musical track: select, for a second playthrough of the musical track a fill from the plurality of fills in the database, wherein, for at least some of the at least one variable fill section in the musical track, the fill selected by processor for the first playthrough is different from the fill selected by the processor for the second playthrough.

In some embodiments, the database can store, for each fill of the plurality of fills, a set of characterizing parameters, wherein the processor is configured to select the fill from the plurality of fills based on the sets of characterizing parameters.

In some embodiments, the set of characterizing parameters can include at least one of a fill length, a style, a tempo, a beat type, and a difficulty level.

In some embodiments, for each variable fill section of the at least one variable fill section in the musical track, the selection of the fill from the plurality of fills is further based on one or more characterizing parameters associated with the musical track.

In some embodiments, for a particular variable fill section of the at least one variable fill section in the musical track, the selection of the fill from the plurality of fills is further based on one or more characterizing parameters associated with the particular variable fill section.

In some embodiments, the processor can be configured to select the fill from the plurality of fills for each section in the musical track that can be varied before beginning to play the musical track.

In some embodiments, the processor can be configured to select the fill from the plurality of fills for each section in the musical track that can be varied while playing the musical track.

In another aspect, the present disclosure is directed at a computerized method for varying a play experience of a player of a rhythm-action game. The method can be executed by a computing device comprising at least one processor and at least one memory in communication with the at least one processor. The computerized method can comprise storing in the at least one memory a musical track, the musical track having at least one variable fill section. The method can also comprise storing, in the memory, a database having a plurality of fills for the at least one variable fill section, each fill being associated with a different set of cues, wherein each cue directs the player to provide an input. The method can also comprise, for each variable fill section of the at least one variable fill section in the musical track, selecting, for a playthrough of the musical track, by the at least one processor, a fill from the plurality of fills in the database. The method can also comprise transmitting display data to a display in communication with the at least one processor, the display data comprising at least part of the set of cues associated with the set of cues associated with the selected fill. The method can also comprise, for each displayed cue, receiving user input, evaluating whether the received player input corresponds to the input directed by the displayed cue, and altering an aspect of gameplay based on the evaluation.

In some embodiments, the method can comprise muting or distorting the soundtrack associated with the corresponding selected fill when the user input does not correspond to the displayed set of cues. For example, each fill of the plurality of fills in the database can be further associated with a different soundtrack. Altering an aspect of gameplay based on the evaluation can comprise: when the received user input corresponds to the input directed by the displayed cue, playing at least a portion of the soundtrack associated with the fill that is associated with the set of cues of which the displayed cue is a part, and when the received user input does not correspond to the input directed by the displayed cue, playing at least one of a muffled, muted, or distorted version of the soundtrack associated with the fill that is associated with the set of cues of which the displayed cue is a part.

In some embodiments, the user input can be received via a simulated drum controller, and the plurality of fills can comprise a plurality of drum fills. For example, each cue can direct the player to provide an input corresponding to a drum pad of a plurality of drum pads on a drum controller. Receiving player input can comprise receiving input from the drum controller indicating which drum pad on the drum controller has been activated; and evaluating whether the received player input corresponds to the input directed by the displayed cue comprises evaluating whether the activated drum pad corresponds to the drum pad directed by the displayed cue.

In some embodiments, each soundtrack associated with each fill of the plurality of fills can be played according to a plurality of synthesizer settings; and playing at least a portion of the soundtrack when the received user input corresponds to the input directed by the displayed cue comprises: selecting a synthesizer setting, and playing the at least a portion of the soundtrack using the selected synthesizer setting.

In some embodiments, the selection of the synthesizer setting can be based at least in part on at least one characterizing parameter associated with at least one of the musical track, a variable fill section of the musical track, and a fill section selected by the at least one processor.

In some embodiments, the playthrough is a first playthrough, and the method can further comprise, for each variable fill section of the at least one variable fill section in the musical track: selecting, for a second playthrough of the musical track, by the at least one processor, a fill from the plurality of fills in the database, wherein, for at least some of the at least one variable fill section in the musical track, the fill selected by the at least one processor for the first playthrough is different from the fill selected by the at least one processor for the second playthrough.

In some embodiments, the method can comprise storing, for each fill of the plurality of fills, a set of characterizing parameters, wherein the selection of the fill from the plurality of fills is based on the sets of characterizing parameters.

In some embodiments, the set of characterizing parameters can include at least one of a fill length, a style, a tempo, a beat type, and a difficulty level.

In some embodiments, for each variable fill section of the at least one variable fill section in the musical track, the selection of the fill from the plurality of fills is further based on one or more characterizing parameters associated with the musical track.

In some embodiments, for a particular variable fill section of the at least one variable fill section in the musical track, the selection of the fill from the plurality of fills is further based on one or more characterizing parameters associated with the particular variable fill section.

In some embodiments, the selection of the fill from the plurality of fills for each section in the musical track that can be varied can occur before beginning to play the musical track.

In some embodiments, the selection of the fill from the plurality of fills for each section in a musical track that can be varied can occur while playing the musical track.

In another aspect, the present disclosure is directed at non-transitory computer readable media storing machine-readable instructions that are configured to, when executed by at least one processor, cause the at least one processor to: access from at least one memory: a musical track, the musical track having at least one variable fill section, and a database having a plurality of fills for the at least one variable fill section, each fill being associated with a different set of cues, wherein each cue directs the player to provide an input; and for each variable fill section of the at least one variable fill section in the musical track: (i) select, for a playthrough of the musical track, a fill from the plurality of fills in the database; (ii) transmit display data to a display, the display data comprising at least part of the set of cues associated with the selected fill; and (iii) for each displayed cue: (a) receive player input; (b) evaluate whether the received player input corresponds to the input directed by the displayed cue; and (c) alter an aspect of gameplay based on the evaluation.

BRIEF DESCRIPTION OF THE DRAWINGS

For a more complete understanding of the present disclosure, reference is now made to the following descriptions taken in conjunction with the accompanying drawing, in which.

DETAILED DESCRIPTION

Figure 1:
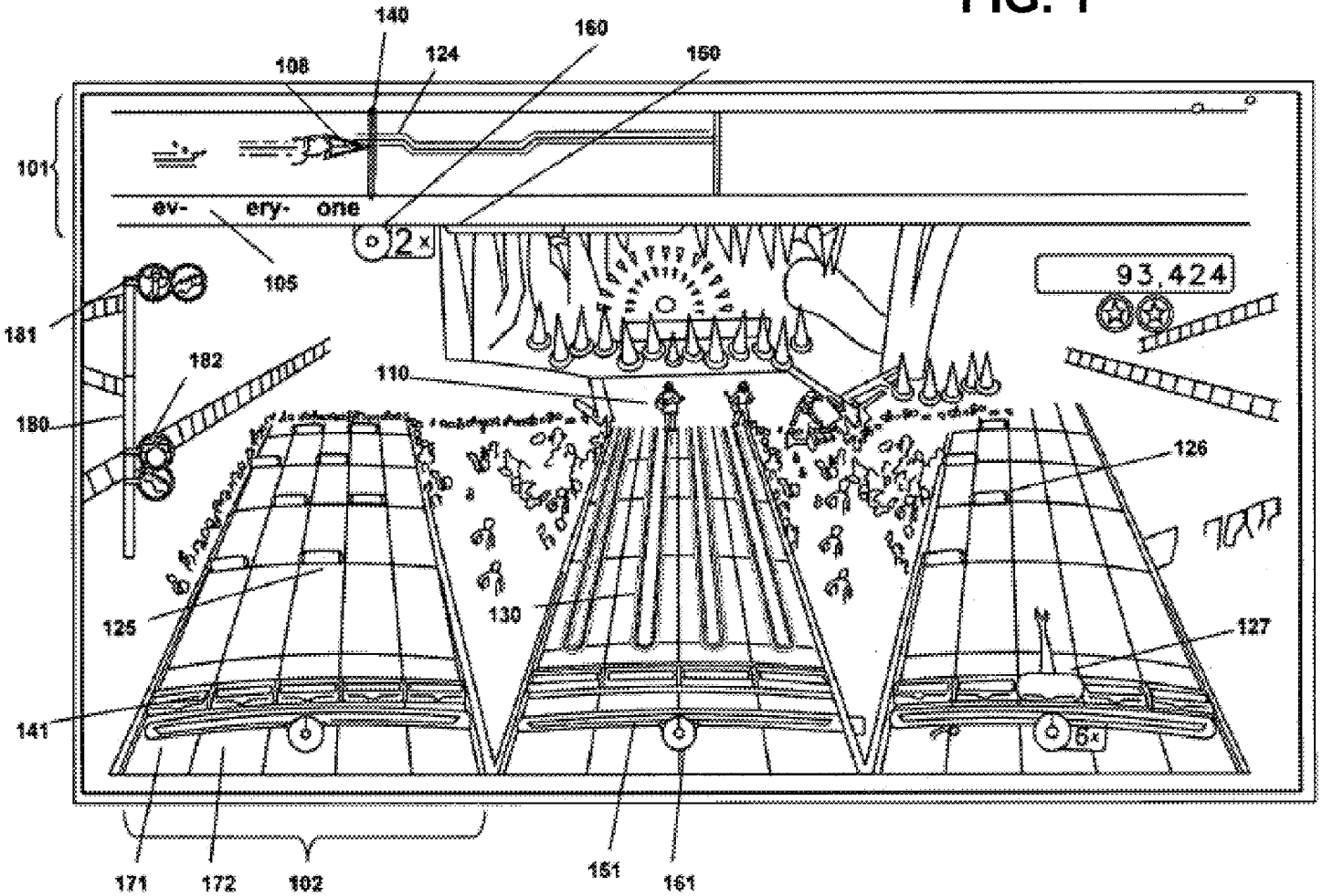
FIG. 1 is an example of one embodiment of a screen display of players emulating a musical performance, according to some embodiments.

Referring now to FIG. 1, an embodiment of a screen display for a video game in which four players emulate a musical performance is shown. One or more of the players may be represented on screen by an avatar 110. Although FIG. 1 depicts an embodiment in which four players participate, any number of players may participate simultaneously. For example, a fifth player may join the game as a keyboard player. In this case, the screen may be further subdivided to make room to display a fifth avatar and/or music interface. In some embodiments, an avatar 110 may be a computer-generated image. In other embodiments, an avatar may be a digital image, such as a video capture of a person. An avatar may be modeled on a famous figure or, in some embodiments, the avatar may be modeled on the game player associated with the avatar.

Still referring to FIG. 1, a lane 101 102 has one or more game "cues" 124, 125, 126, 127, 130 corresponding to musical events distributed along the lane. During gameplay, the cues, also referred to as "musical targets," "gems," or "game elements," appear to flow toward a target marker 140, 141. In some embodiments, the cues may appear to be flowing towards a player. The cues are distributed on the lane in a manner having some relationship to musical content associated with the game level. For example, the cues may represent note information (gems spaced more closely together for shorter notes and further apart for longer notes), pitch (gems placed on the left side of the lane for notes having lower pitch and the right side of the lane for higher pitch), volume (gems may glow more brightly for louder tones), duration (gems may be "stretched" to represent that a note or tone is sustained, such as the gem 127), articulation, timbre or any other time-varying aspects of the musical content. The cues may be any geometric shape and may have other visual characteristics, such as transparency, color, or variable brightness.

As the gems move along a respective lane, musical data represented by the gems may be substantially simultaneously played as audible music. In some embodiments, audible music represented by a gem is only played (or only played at full or original fidelity) if a player successfully "performs the musical content" by capturing or properly executing the gem. In some embodiments, a musical tone is played to indicate successful execution of a musical event by a player. In other embodiments, a stream of audio is played to indicate successful execution of a musical event by a player. In certain embodiments, successfully performing the musical content triggers or controls the animations of avatars.

In some embodiments, the audible music, tone, or stream of audio represented by a cue is modified, distorted, or otherwise manipulated in response to the player's proficiency in executing cues associated with a lane. For example, various digital filters can operate on the audible music, tone, or stream of audio prior to being played by the game player. Various parameters of the filters can be dynamically and automatically modified in response to the player capturing cues associated with a lane, allowing the audible music to be degraded if the player performs poorly or enhancing the audible music, tone, or stream of audio if the player performs well. For example, if a player fails to execute a game event, the audible music, tone, or stream of audio represented by the failed event may be muted, played at less than full volume, or filtered to alter its sound.

In some embodiments, a "wrong note" sound may be substituted for the music represented by the failed event. Conversely, if a player successfully executes a game event, the audible music, tone, or stream of audio may be played normally. In some embodiments, if the player successfully executes several, successive game events, the audible music, tone, or stream of audio associated with those events may be enhanced, for example, by adding an echo or "reverb" to the audible music. The filters can be implemented as analog or digital filters in hardware, software, or any combination thereof. Further, application of the filter to the audible music output, which in many embodiments corresponds to musical events represented by cues, can be done dynamically, that is, during play. Alternatively, the musical content may be processed before game play begins. In these embodiments, one or more files representing modified audible output may be created and musical events to output may be selected from an appropriate file responsive to the player's performance.

In addition to modification of the audio aspects of game events based on the player's performance, the visual appearance of those events may also be modified based on the player's proficiency with the game. For example, failure to execute a game event properly may cause game interface elements to appear more dimly. Alternatively, successfully executing game events may cause game interface elements to glow more brightly. Similarly, the player's failure to execute game events may cause their associated avatar to appear embarrassed or dejected, while successful performance of game events may cause their associated avatar to appear happy and confident. In other embodiments, successfully executing cues associated with a lane causes the avatar associated with that lane to appear to play an instrument. For example, the drummer avatar will appear to strike the correct drum for producing the audible music. Successful execution of a number of successive cues may cause the corresponding avatar to execute a "flourish," such as kicking their leg, pumping their fist, performing a guitar "windmill," spinning around, winking at the "crowd," or throwing drum sticks.

Player interaction with a cue may be required in a number of different ways. In general, the player is required to provide input when a cue passes under or over a respective one of a set of target markers 140, 141 disposed on the lane. Player interaction with a cue may comprise any manipulation of any simulated instrument and/or game controller.

As shown in FIG. 1, each lane may be subdivided into a plurality of segments. Each segment may correspond to some unit of musical time, such as a beat, a plurality of beats, a measure, or a plurality of measures. Although the embodiment shown in FIG. 1 show equally sized segments, each segment may have a different length depending on the particular musical data to be displayed. In addition to musical data, each segment may be textured or colored to enhance the interactivity of the display. For embodiments in which a lane comprises a tunnel or other shape (as described above), a cursor is provided to indicate which surface is "active," that is, with which lane surface a player is currently interacting. In these embodiments, the viewer can use an input device to move the cursor from one surface to another. As shown in FIG. 1, each lane may also be divided into a number of sub-lanes, with each sub-lane containing musical targets indicating different input elements. For example, the lane 102 is divided into five sublanes, including sub-lanes 171 and 172. Each sub-lane may correspond to a different fret button on the neck of a simulated guitar.

In some embodiments (not shown), instead of a lane extending from a player's avatar, a three-dimensional "tunnel" comprising a number of lanes extends from a player's avatar. The tunnel may have any number of lanes and, therefore, may be triangular, square, pentagonal, sextagonal, septagonal, octagonal, nonagonal, or any other closed shape. In still other embodiments, the lanes do not form a closed shape. The sides may form a road, trough, or some other complex shape that does not have its ends connected. For ease of reference throughout this document, the display element comprising the musical cues for a player is referred to as a "lane."

Referring back to FIG. 1, in some embodiments, improvisational or "fill" sections may be indicated to a drummer or any other instrumentalist. In FIG. 1, a drum fill is indicated by long tubes 130 filling each of the sub-lanes of the center lane which corresponds to the drummer. The type of drum fill depicted in FIG. 1 is referred to as a "classical" drum fill, where the drummer can play randomly using any input pad on his drum controller, at any desired tempo or rhythm (indeed, the drummer can play without any semblance of rhythm). As the player strikes each input pad, the sound associated with that input pad can be played by the rhythm-action game as audible sound, just as if the player is playing a real drum. In such "classical" drum fill embodiments, scoring can be suspended such that the player can play anything without having any effect on his score.

Still referring to FIG. 1, an indicator of the performance of a number of players on a single performance meter 180 is shown. In brief overview, each of the players in a band may be represented by an icon 181, 182. In the figure shown the icons 181 182 are circles with graphics indicating the instrument the icon corresponds to. For example, the icon 181 contains a microphone representing the vocalist, while icon 182 contains a drum set representing the drummer. The position of a player's icon on the meter 180 indicates a current level of performance for the player. A colored bar on the meter may indicate the performance of the band as a whole. Although the meter shown displays the performance of four players and a band as a whole, in other embodiments, any number of players or bands may be displayed on a meter, including two, three, four, five, six, seven, eight, nine, or ten players, and any number of bands.

Individual player performance levels may be indicated on the meter in any manner. In the embodiment shown in FIG. 1, the icons 181, 182 displayed to indicate each player may comprise any graphical or textual element. In some embodiments, the icons may comprise text with the name of one or more of the players. In another embodiment the icon may comprise text with the name of the instrument of the player. In other embodiments, the icons may comprise a graphical icon corresponding to the instrument of the player. For example, an icon containing a drawing of a drum 182 may be used to indicate the performance of a drummer. Although described above in the context of a single player providing a single type of input, a single player may provide one or more types of input simultaneously. For example, a single player providing instrument-based input (such as for a lead guitar track, bass guitar track, rhythm guitar track, keyboard track, drum track, or other percussion track) and vocal input simultaneously.

Still referring to FIG. 1, meters 150, 151 may be displayed for each player indicating an amount of stored bonus. The meters may be displayed graphically in any manner, including a bar, pie, graph, or number. In some embodiments, each player may be able to view the meters of remote players. In other embodiments, only bonus meters of local players may be shown. Bonuses may be accumulated in any manner including, without limitation, by playing specially designated musical phrases, hitting a certain number of consecutive notes, or by maintaining a given percentage of correct notes.

In some embodiments, if a given amount of bonuses are accumulated, a player may activate the bonus to trigger an in-game effect. An in-game effect may comprise activation of an improvisational of "fill" section indicated to a drummer or any other instrumentalist. An in-game effect may also comprise a graphical display change including, without limitation, an increase or change in crowd animation, avatar animation, performance of a special trick by the avatar, lighting change, setting change, or change to the display of the lane of the player. An in-game effect may also comprise an aural effect, such as a guitar modulation, including feedback, distortion, screech, flange, wah-wah, echo, or reverb, a crowd cheer, an increase in volume, and/or an explosion or other aural signifier that the bonus has been activated. An in-game effect may also comprise a score effect, such as a score multiplier or bonus score addition. In some embodiments, the in-game effect may last a predetermined amount of time for a given bonus activation.

In some embodiments, bonuses may be accumulated and/or deployed in a continuous manner. In other embodiments, bonuses may be accumulated and/or deployed in a discrete manner. For example, instead of the continuous bar shown in FIG. 1, a bonus meter may comprise a number of "lights" each of which corresponds to a single bonus earned. A player may then deploy the bonuses one at a time.

In some embodiments, bonus accumulation and deployment may be different for each simulated instrument. For example, in one embodiment only the bass player may accumulate bonuses, while only the lead guitarist can deploy the bonuses.

FIG. 1 also depicts score multiplier indicators 160, 161. A score multiplier indicator 160, 161 may comprise any graphical indication of a score multiplier currently in effect for a player. In some embodiments, a score multiplier may be raised by hitting a number of consecutive notes. In other embodiments, a score multiplier may be calculated by averaging score multipliers achieved by individual members of a band. For example, a score multiplier indicator 160, 161 may comprise a disk that is filled with progressively more pie slices as a player hits a number of notes in a row. Once the player has filled the disk, the player's multiplier may be increased, and the disk may be cleared. In some embodiments, a player's multiplier may be capped at certain amounts. For example, a drummer may be limited to a score multiplier of no higher than 4× times. Or for example, a bass player may be limited to a score multiplier of no higher than 6× times.

In some embodiments, a separate performance meter (not shown) may be displayed under the lane of each player. This separate performance meter may comprise a simplified indication of how well the player is doing. In one embodiment, the separate performance meter may comprise an icon which indicates whether a player is doing great, well, or poorly. For example, the icon for "great" may comprise a hand showing devil horns, "good" may be a thumbs up, and "poor" may be a thumbs down. In other embodiments, a player's lane may flash or change color to indicate good or poor performance.

Each player may use a gaming platform in order to participate in the game. In one embodiment, the gaming platform is a dedicated game console, such as: PLAYSTATION®3, PLAYSTATION®4, or PLAYSTATION®VITA manufactured by Sony Computer Entertainment, Inc.; WII™, WIT U™, NINTENDO 2DS™, or NINTENDO 3DS™ manufactured by Nintendo Co., Ltd.; or XBOX®, XBOX 360®, or XBOX ONE™ manufactured by Microsoft Corp. In other embodiments, the gaming platform comprises a personal computer, personal digital assistant, or cellular telephone.

Figure 2:
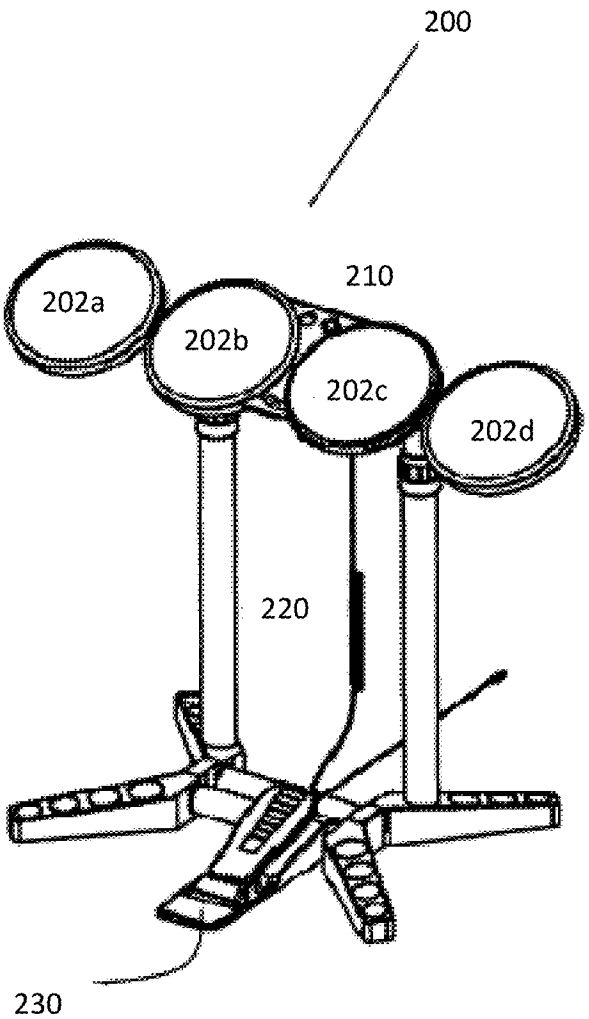
FIG. 2 shows an embodiment of simulated drum set for use with a video game, according to some embodiments.

Referring now to FIG. 2 an embodiment of a simulated drum set for use with a video game are shown. In brief overview, a simulated drum set 200 comprises a number of drum pads 202*a*, 202*b*, 202*c*, 202*d* (generally 202). The simulated drum set 200 may also comprise a controller 210 with various buttons, switches, and/or joysticks. The simulated drum set may also comprise a foot pedal 230 to simulate a foot-activated percussion instrument, such as a bass drum or hi-hat. The simulated drum set 200 may be mounted on a stand 220 to elevate the drum pads 202 and secure the foot pedal 230.

Still referring to FIG. 2, now in greater detail, a simulated drum set may comprise any number of drum pads 202, including without limitation zero, one, two, three, four, five, six, seven, eight, nine, or ten. Upon a user striking a drum pad 202, the drum set 200 may transmit a signal to a game system that the pad was struck. This signal may be transmitted via any means, including cables and wireless signals. The signal may comprise any information about a strike including without limitation the time, force, duration, location on the pad, size of the object striking the pad, and texture of the object striking the pad. For example, the drum set may transmit a signal indicating that pad 202*b* was struck with a force above a given threshold. Or, for example, the drum set may transmit a signal indicating that pad 202*c* was struck very near the rim of the pad.

In some embodiments, the drum pads 202 may be struck with drum sticks used with ordinary drums. In other embodiments, the drum pads 202 may be struck with customized drum sticks designed specially to work with the set 200.

During a game session, each drum pad may be configured to simulate an individual percussion instrument. For example, a user striking a drum pad 202*a* may cause a snare drum sound to be played, while the user striking drum pad 202*b* may cause a tom-tom sound to be player, while the user striking drum pad 202*d* may cause a crash cymbal sound to be played. In some embodiments, the played sound may reflect any of the properties of the user's strike of the drum pad. For example, a game may play a louder snare drum sound in response to a user hitting a drum pad harder. Or for example, a game may alter the sound of a ride cymbal played depending on how close to the center or the rim of the drum pad the user strikes. In some embodiments, the sound played in response to a drum pad strike may be chosen from a prerecorded library of percussion sounds. In other embodiments, in response to a user successfully striking a pad 202 corresponding to an on screen gem, a portion of a prerecorded drum track corresponding to the current song may be played.

The drum set 200 may also comprise a number of foot pedals 230. In some embodiments, a single foot pedal may be provided. In other embodiments, any number of foot pedals may be provided, including two (such as one to simulate a bass drum and one to simulate a hi-hat), three or four. During a game, the foot pedal may be used to create any percussion sound.

In some embodiments, a drum set 200 may comprise a stand 220 which allows a user to sit or stand while playing the drum pads, and still have access to the foot pedal 230. In one embodiment, the stand may allow a user to adjust the height of the drum pads as a whole. In another embodiment, the stand 220 may allow a user to adjust the height of the drum pads individually. In still another embodiment, the stand 220 may allow a user to adjust the position of one or more pads, such as by swiveling one or more pads closer to the player. In some embodiments, the stand 220 may allow a user to adjust the placement of the foot pedal, including moving the foot pedal forwards, backwards, and side-to-side. In one embodiment, the foot pedal and/or drum pads 202 may be detachable from the stand. In this embodiment, the drum pads 202 may be placed on a table top or held on a player's lap.

In some embodiments, a simulated drum set 200 may include a controller 210. The controller may comprise inputs for configuring the simulated drum set, including, for example, sensitivity, left/right handed switching, and turning the drum set on and off. The controller 210 may also comprise any other game inputs. In some embodiments, the controller 210 may comprise some or all of the functionality of a standard game controller for any of the game systems described herein. In some embodiments, the controller may be used for navigating menus, or inputting configuration or other game data.

A simulated drum set 200 may also comprise any other elements incorporated in game controllers. In some embodiments, a drum set 200 may comprise a speaker which may provide individual feedback to the player about the player's performance. In large multiplayer games, this individual speaker may assist a player in assessing their performance and hearing whether or not they missed a note. In other embodiments, a drum set 200 may comprise a microphone which may be used to chat with other players, provide vocal input, or provide hand claps, microphone taps, or other aural input. In other embodiments, such an individual speaker may be included in any other simulated instrument, including a guitar and/or microphone.

In some embodiments, the drum pads 202 and/or foot pedal 230 may be color coded. For example, drum pad 202*a* may be green, pad 202*b* may be red, pad 202*c* may be yellow, pad 202*d* may be blue, and the foot pedal 230 may be orange. Color coding may be indicated in any manner, including the color of the pads 202, the color of the rims surround the pads 202, the color of an icon or design on the pads 202 or rims, or one or more labels on the pads, rims, and/or stand. The color code of the foot pedal may also be indicated in any manner, including the color of the foot pedal, the color of a design or icon on the foot pedal, or one or more labels on the foot pedal or stand.

In addition to being used during gameplay, in some embodiments the simulated drum set may be used to navigate one or more menus or produce other game input. For example, a game may display a menu to users in which different menu options are color coded. A user may then strike the drum pad or stomp the foot pedal corresponding to the color of a menu option to activate that menu option. Or for example, a series of menus may be provided in which a user may use two drums 202*b* 202*c* to cycle up and down among choices within a menu, and use two drums 202*a*, 202*d* to move forward and backward between different menus. In some embodiments, one or more drums may be assigned a designated function throughout a game interface. For example, during the course of navigating a series of menus, startup, and/or configuration screens, a player may always be able to use the foot pedal to return to a main screen. Or for example, the player may always be able to use the leftmost drum 202*d* to alter a currently selected option. In some embodiments, navigating menus and configuration screens may be done via a combination of the drum pads, foot pedal, and controller.

Figure 3:
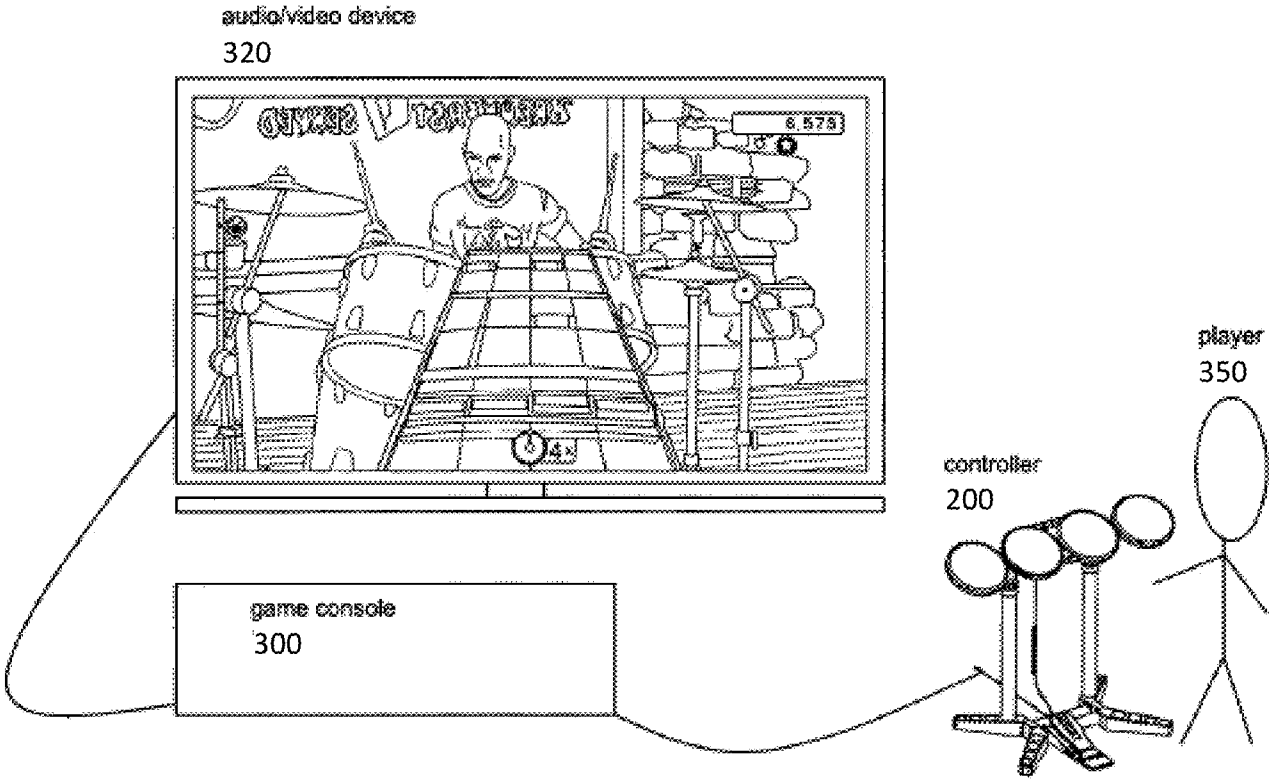
FIG. 3 illustrates one embodiment of a game with a game console coupled to a simulated drum set and an audio/video device, according to some embodiments.

FIG. 3 shows an exemplary game console connected to both controller 200 and an audio/video device 320. In FIG. 3, the game on the game platform 300 is providing drum level data (cues indicating drum pedal and foot pad activations) to the player 350 responsive to detecting a simulated drum controller connected to the platform. The game on game platform 300 also provides video and audio information to audio/video device 320, which displays the video and cues described above, as well as outputs the sounds associated with the video game.

Figure 4:
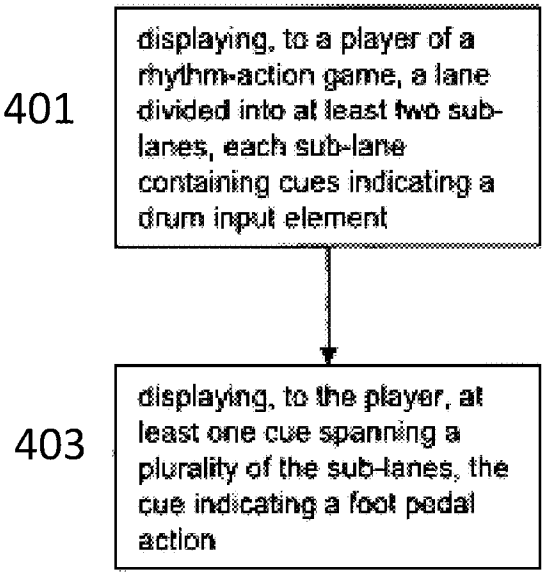
FIG. 4 is a flow diagram illustrating a method for using a simulated drum set with a video game, according to some embodiments.

Referring now to FIG. 4, a flow diagram of one embodiment of a method for displaying a foot-pedal cue in a rhythm-action game is shown. In brief overview, the method includes: displaying, to a player of a rhythm-action game, a lane divided into at least two sub-lanes, each sub-lane containing cues indicating a drum input element (step 401); and displaying, to the player, an additional cue spanning a plurality of the sub-lanes, the additional cue indicating a foot pedal action (step 403). In some embodiments, the additional cue may span all the sub-lanes. In some embodiments, the additional cue may be a different color than other cues. In other embodiments, a lane may be divided into any number of sub-lanes including without limitation, two, three, four, five, six, seven, eight, nine, or ten sub-lanes. A sub-lane may comprise any division of a lane containing cues corresponding to a single input element, and may comprise any shape or orientation.

In some embodiments, lines or other demarcations may be displayed in between sub-lanes. For example, referring back to FIG. 1, a line is used to indicate a separation between sub-lane 171 and sub-lane 172. In other embodiments, no such line or demarcation may be displayed. For example, referring ahead to FIG. 5, the lane shown is divided into four sub-lanes, 551, 552, 553, 554 which are not separated by lines or other indicators.

Figure 5:
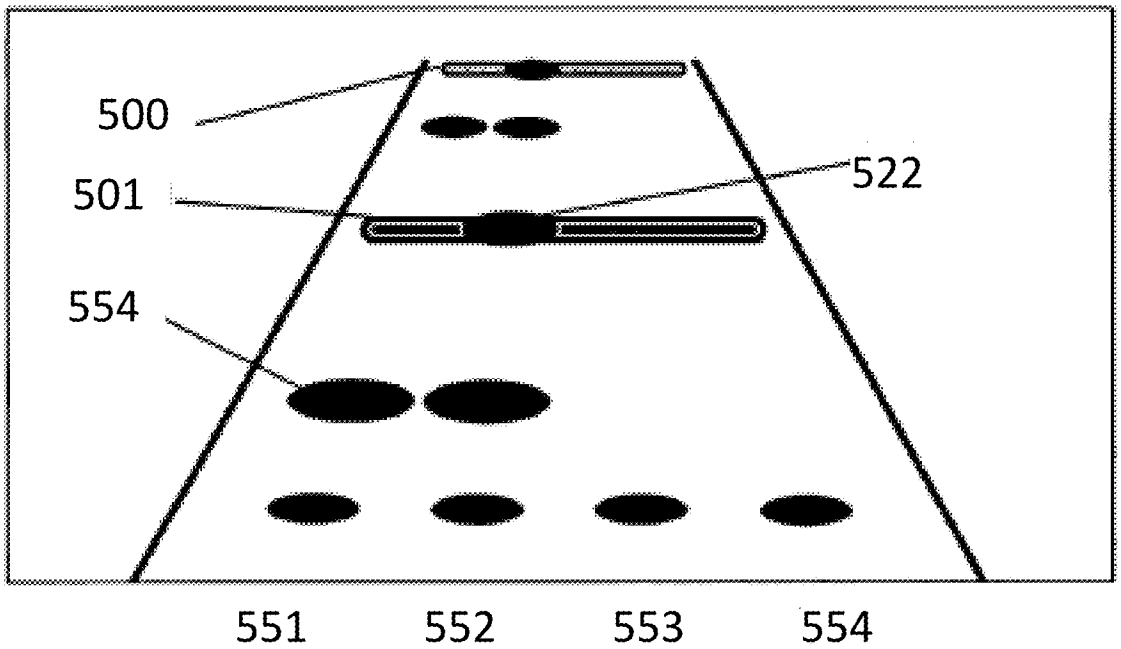
FIG. 5 is a flow diagram of a method for displaying a foot-pedal cue in a rhythm-action game, according to some embodiments.

In some embodiments, each sub-lane may contain cues corresponding to a different drum pad. For example, a lane may be divided into four sub-lanes, each sub-lane corresponding to one of four drum pads. Referring ahead to FIG. 5, an example diagram of such a lane is shown. The lane is divided into four sub-lanes, 551, 552, 553, 554. Each lane may correspond to a drum pad in a linear arrangement. For example, using the drum set 200 from FIG. 2, sub-lane 551 may correspond to drum pad 202*a*, sub-lane 552 may correspond to drum pad 202*b*, sub-lane 553 may correspond to drum pad 202*c*, and sub-lane 554 may correspond to drum pad 202*d*. As used herein a "linear" arrangement of drum pads or other input elements does not necessarily indicate input elements arranged in a straight line, but rather any arrangement of input elements which have a clear left-to-right sequence or top-to-bottom sequence. For example, the drum set 200 may be configured such that the pads 202*a*, 202*b*, 202*c*, 202*d* are arranged in a curve where pads 202*a* and 202*d* are moved closer to the player. In this case the pads still comprise a linear arrangement for purposes of this description, as they still have a clear left-to-right sequence.

In some embodiments, cues in each sub-lane may always correspond to a given percussion sound during a song. For example, cues in sub-lane 551 may correspond to a snare drum, while cues in sub-lane 552, 553 may correspond to tom-tom sounds while cues in sub-lane 554 may correspond to crash cymbal sounds. In other embodiments, cues in a single sub-lane may correspond to different percussion sounds over the course of a song. For example, during the course of a song, gems in sub-lane 554 may first correspond to cowbell sounds, and then correspond to a crash cymbal sound. In some embodiments, the display of cues within a sub-lane may be changed to indicate to a user that the cues represent a different percussion sound.

Figure 6:
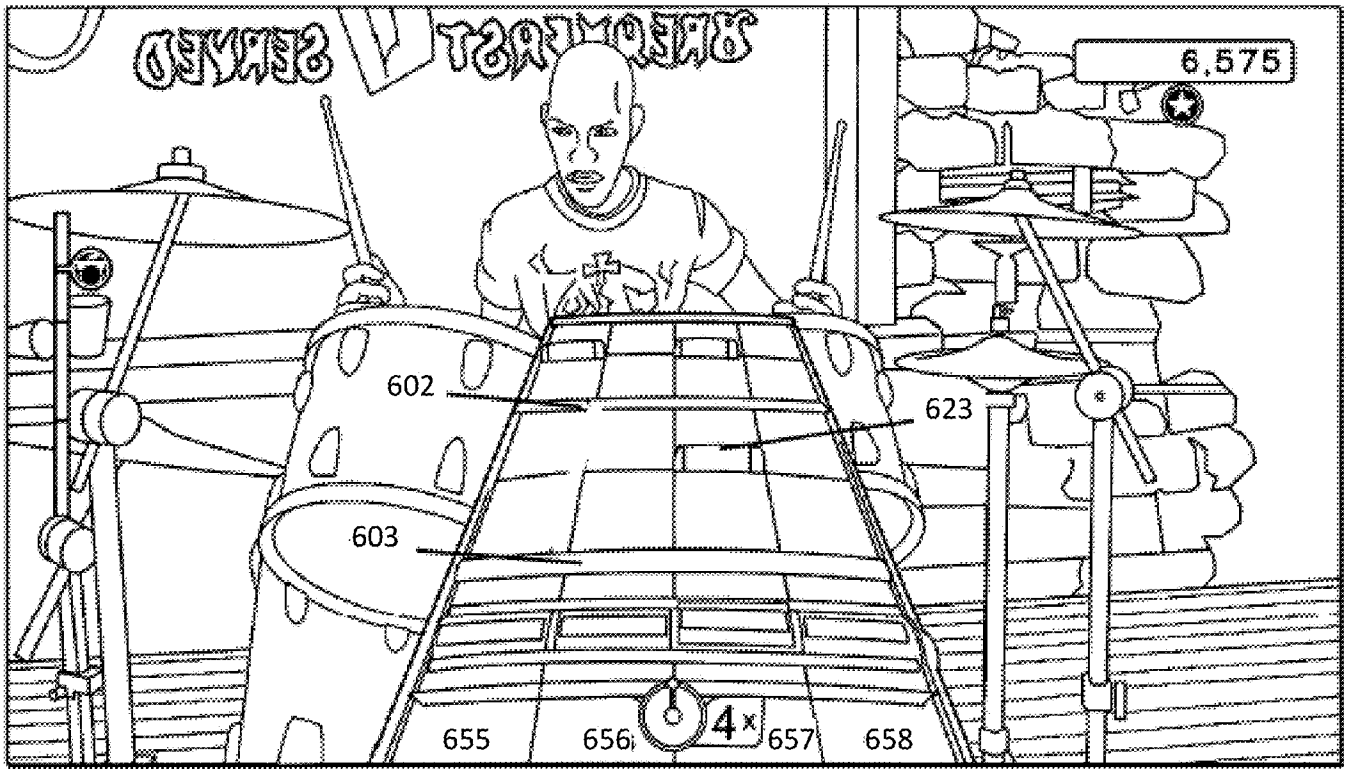
FIG. 6 is an illustration of one embodiment of displaying cues spanning a plurality of sub-lanes, according to some embodiments.

Referring back to FIG. 4, a cue spanning a plurality of the sub-lanes may be displayed in any manner (step 403). In some embodiments, the cue may indicate a foot-pedal action. In some embodiments, the cue may span all the sub lanes, such as the cues 500 and 501 in FIG. 5, the cues 602, 603 in FIG. 6. The cue spanning a plurality of the sub-lanes may be displayed in any shape, size or color.

A cue may span a plurality of sub-lanes by occupying a portion of visual space corresponding to each of the plurality of sub-lanes. In some embodiments, a cue may span a plurality of sub-lanes by being displayed as covering some or all of each of the plurality of sub-lanes. For example, the cue 603 in FIG. 6 covers a portion of each of the sub lanes 655, 656, 657, and 658. Or for example, the cue 500 in FIG. 5 covers a portion of each of the sub lanes 551, 552, 553, and 554. This is true even though a portion of the cue 501 in sub-lane 552 is in turn overlaid by a cue 522 which corresponds to sub-lane 552. In other embodiments, a cue may span a plurality of sub-lanes by being displayed in space above or below each of the plurality of sub-lanes. For example, a cue may be displayed that appears to "hover" over the plurality of sub-lanes. Or for example, a cue may be displayed that appears to be attached to the bottom or hovering beneath each of the plurality of the plurality of sub-lanes.

In some embodiments, a cue spanning a plurality of sub-lanes may have one or more cues corresponding to an individual sub-lane overlaid on the cue. For example, the cue 501 in FIG. 5 is displayed such that it appears to be "under" the cue 522.

In some embodiments, a cue spanning a plurality of sub-lanes may comprise a different color than any of the cues corresponding to individual sub-lanes.

Further details regarding visual cues, input methods, scoring methods, and methods for varying a display based on user input for rhythm-action games can be found in application Ser. No. 12/139,819, filed Jun. 16, 2008, titled "SYSTEMS AND METHODS FOR SIMULATING A ROCK BAND EXPERIENCE." The entire contents of that application are incorporated herein by reference.

Figure 7:
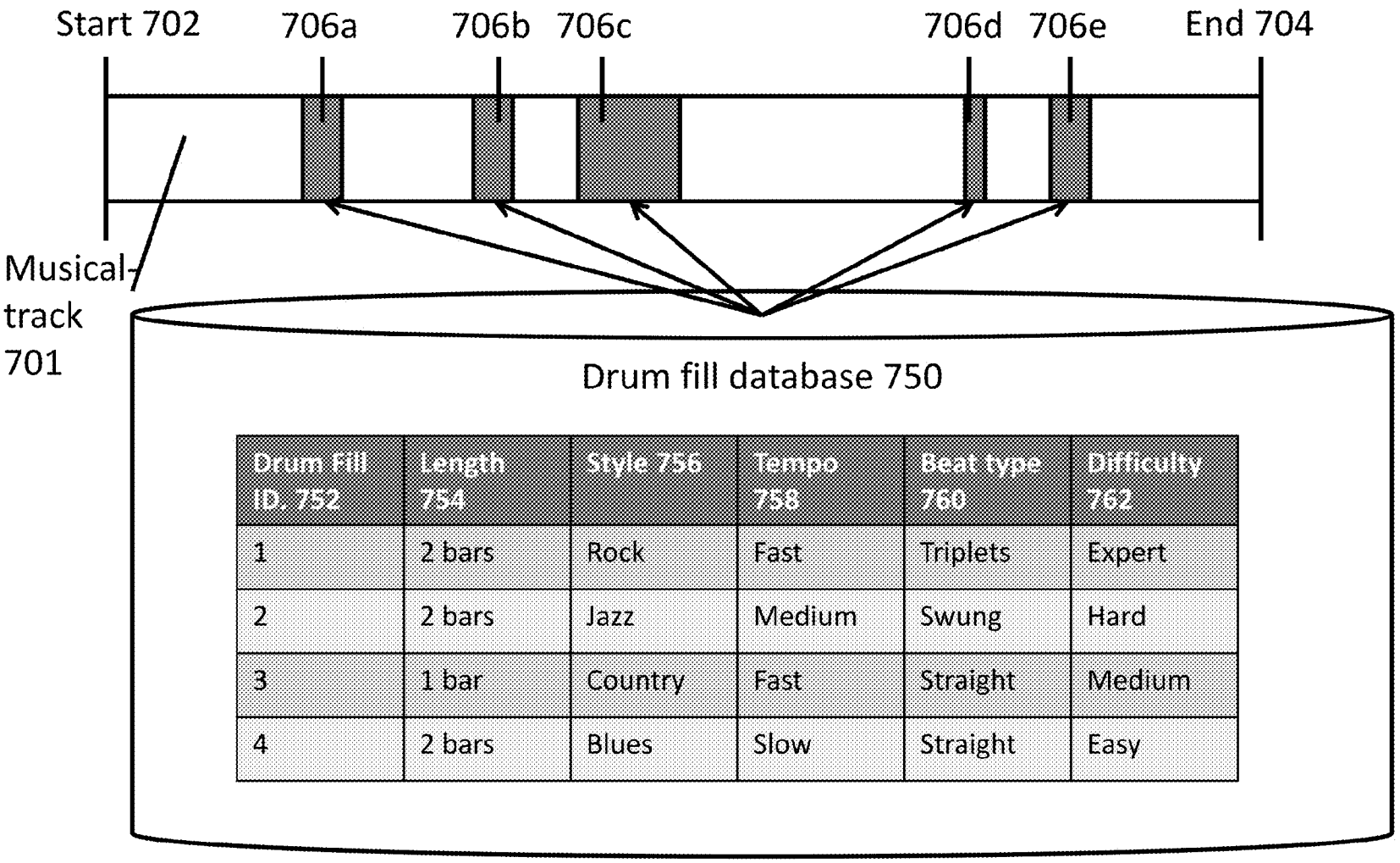
FIG. 7 is a conceptual block diagram illustrating a dynamic drum improvisational or "fill" feature, according to some embodiments.

FIG. 7 is a conceptual block diagram illustrating a dynamic drum improvisational or "fill" feature, according to some embodiments. A particular song or musical track can have associated musical track data comprising pre-authored notes and cues encoded in a digital format, such as MIDI. This musical track data can be used by the game, e.g., game console 300, to play the musical track, display visual cues, and receive and score user input. Such musical track data is represented in FIG. 7 as a musical-track 701 having a start 702 and an end 704. The musical-track 701 can have pre-determined segments at which a dynamic drum fill improvisation or "fill" section can be inserted—these segments are represented in FIG. 7 as fill sections 706*a*, 706*b*, 706*c*, 706*d*, and 706*e* (generally 706). As depicted in FIG. 7, fill segments 706 can vary in length from two beats to multiple bars in length. For example, fill section 706*c* is depicted as substantially longer than fill section 706*d*. While FIG. 7 displays five fill sections, a song track can have any number of fill sections, including zero sections.

The rhythm-action game can be set to play according to any of at least three modes: a "no-fill" mode, a "classic" fill mode, and a "pre-authored" fill mode. In the no-fill mode, the rhythm-action game can treat fill sections 706 like any other part of the song—a set of pre-authored cues can be displayed and scored, wherein the set of pre-authored cues remain the same every time musical-track 701 is played. When the drummer provides input that corresponds to the pre-authored cues, the portion of the musical track that corresponds to the set of pre-authored cues is played. When the drummer provides input that does not correspond to the pre-authored cues, the portion of the musical track that corresponds to the pre-authored cues can be muted or distorted (e.g., played at less than full volume, filtered to alter its sound, replaced with a "wrong note" sound, etc.). In the no-fill mode, the set of pre-authored cues and accompanying soundtrack does not change with each play through of musical-track 701; the player's experience will remain the same every time.

In the "classic" fill mode, the rhythm-action game can display the cues associated with the "classical" drum fill described above in relation to FIG. 1. For example, the rhythm-action game can display long tubes 130 filling each of the sub-lanes which corresponds to the drummer. In the "classic" fill mode, the drummer can play randomly using any input pad on his drum controller, at any desired tempo or rhythm (e.g., or even with no rhythm at all). When playing in the "classical" drum fill mode, scoring can be suspended such that the player can play anything without having any effect on his score. As explained herein, in this mode, when the player strikes each input pad, the sound associated with that input pad can be played by the rhythm-action game as audible sound, just as if the player is playing a real drum.

In the "pre-authored" fill mode, the rhythm-action game can draw from a database 750 of pre-authored drum fills to fill each fill section 706, such that different fills are slotted into each fill section 706 every time musical-track 701 is played. Each pre-authored fill can include a different soundtrack and a different set of visual cues for directing the player to provide different input. The visual cues displayed for a fill in the pre-authored fill mode can be similar to but visually distinguishable from regular cues. For example, the fill cues can glow, be colored a different color, appear brighter, or alter other aspects of their appearance. In some embodiments, scoring will not be suspended for the pre-authored fill mode—instead, the player continues to be evaluated based on how well the player executes the visual cues provided for the selected pre-authored drum fill.

The "pre-authored" fill mode can have several advantages over the "no-fill" and the "classic" fill mode. For example, the "pre-authored" fill mode provides the player with different experiences even when the same musical-track 701 is played, and therefore facilitates greater variety and replayability for the player. The "pre-authored" fill mode can also mitigate issues with system lag associated with the "classical" drum fill mode. In the "classical" drum fill mode, there can be a noticeable delay between the time when the player strikes an input pad and the time when the sound associated with that input pad strike is played as audible sound. This lag can be caused by delays associated with receiving, digitizing, processing the player's input, as well as in synthesizing and playing the audible sound. In the "pre-authored" fill mode, however, the system can know in advance what a correctly played drum fill should sound like, and can therefore decrease the amount of lag time between when the player strikes an input pad and the time when the sound associated with that input pad strike is played. For example, the system can load the correct audible sound associated with a certain fill, and can choose to simply mute, unmute, or distort the sound track depending on whether the player executes the fill correctly. This can mitigate issues with system lag and provides the user with a more realistic and responsive drum-playing experience.

In some embodiments, e.g., in both the "classical" drum fill mode and the "pre-authored" fill mode, the rhythm-action game can be configured to provide an improvisational fill only if the player's has accumulated a certain amount of stored bonus. A player's stored bonus can be indicated by meter 151. If, for example, the player's stored bonus is below a pre-determined threshold, such as if meter 151 is below 50% full, the rhythm-action game can be configured to display only default notes instead of fill notes, e.g., to operate as if the game is set to "no-fill" mode. If the player's stored bonus is equal to or above the pre-determined threshold (such as if meter 151 is 50% full or more), the rhythm-action game can provide either a "classical" fill or a "pre-authored" fill, depending on which mode the game is configured to implement.

In the "pre-authored" fill mode, the rhythm-action game (e.g., as implemented on game console 300) can select drum fills for each of the fill sections 706 in musical-track 701 when musical-track 701 is first loaded in preparation for play. In these embodiments, each fill section 706 will already have been assigned a pre-authored drum fill by the time the player begins to play. In other embodiments, the rhythm-action game can select drum fills for each of the fill sections 706 dynamically, e.g., as the player is playing through the musical-track 701.

Pre-authored drum fills can be stored in a drum fill database 750, and can be associated with certain characterizing parameters. For example, each drum fill can be identified by a unique identifier (column 752). Drum fill database 750 can also store an indication of each drum fill's length (column 754). While FIG. 7 depicts only drum fills that are 1 or 2 bars in length, other lengths are also possible, including fills as short as one or two beats, or fills that last for several bars.

Drum fill database 750 can also store an indication of each drum fill's style (column 756). As used herein, the term "style" can refer to the musical genre for which each drum fill is most appropriate. FIG. 7 provides several examples of such styles, including Rock, Jazz, Country, or Blues. In some embodiments, the style parameter can include more than one indication, such as a drum fill that can be designated appropriate for both "Rock" and "Country."

Drum fill database 750 can also store an indication of each drum fill's tempo (column 758). As depicted in FIG. 7, drum fill database 750 can categorize each drum fill according to discrete categories, such as "Fast" tempo, "Medium" tempo, or "Slow" tempo. Alternatively, drum fill database 750 can characterize the tempo of each drum fill according to an "ideal" beats per minute (bpm), or according to a range of bpm for which the drum fill is best suited.

Drum fill database 750 can store the "beat type" associated with each drum fill (column 760). As used herein, the term "beat type" can refer to different ways to describe the rhythm associated with a drum fill. For example, a rhythm associated with a drum fill can be characterized according to how the drum fill predominantly subdivides one note in a measure. Some drum fills can use duplets, e.g., drum fills that subdivide one note into two parts, which can result in a "straight" sounding rhythm. Some drum fills can use triplets, e.g., drum fills that subdivide one note into three parts, which can result in a faster, more complicated rhythm. If the drum fill uses triplets but omits the second note in the triplet, the result can be a rhythm that sounds like a "swing" or a "swung" beat. Other ways of characterizing the rhythm of a drum fill can also be captured by the "beat type" parameter.

Drum fill database 750 can also store the difficulty of a drum fill (column 762). Drum fills can be categorized into discrete difficulty categories, such as "Easy," "Medium," "Hard," and "Expert." Drum fills can be categorized into one or more of these difficulty categories depending on the number and rate at which notes appear, the number and type of input pads that the player is cued to play, as well as other factors. In some embodiments, drum fills can be categorized into more than one category—for instance, the set of drum fills categorized "medium" difficulty can include every drum fill categorized "easy" difficulty as well as additional drum fills; the set of drum fills categorized "hard" difficulty can include every drum fill categorized "medium" difficulty as well as additional drum fills; and the set of drum fills categorized "expert" difficulty can include every drum fill categorized "hard" difficulty as well as additional drum fills. In other embodiments, drum fills can be categorized into only one difficulty level.

Figure 8:
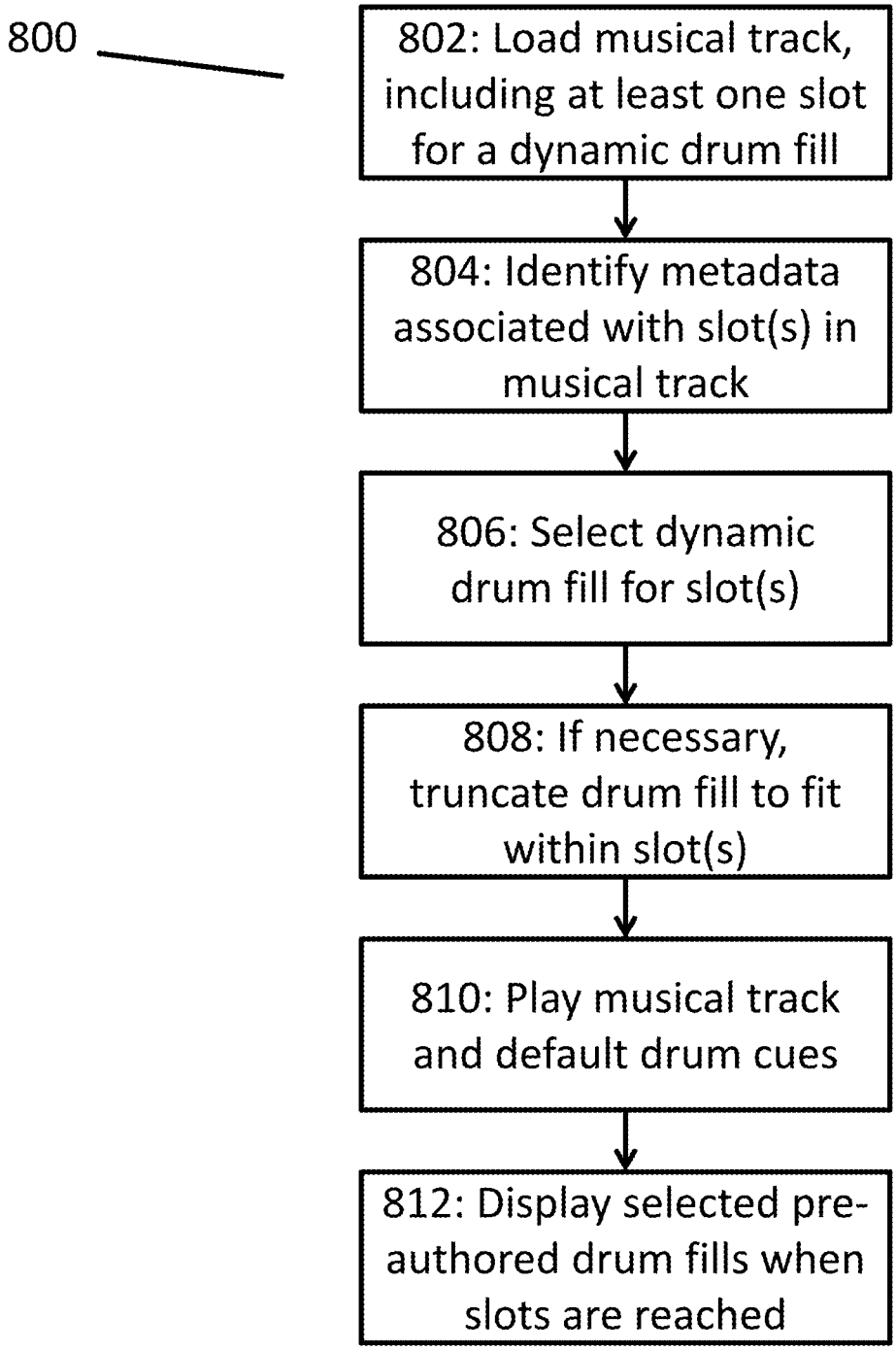
FIG. 8 is a flowchart illustrating an exemplary process for implementing a pre-authored improvisational fill mode, according to some embodiments.

FIG. 8 is a flowchart illustrating a process 800 for implementing a pre-authored improvisational fill mode, according to some embodiments. The process 800 can be implemented by a game console running the disclosed rhythm-action game. At step 802, a musical track, such as musical-track 701, can be loaded by process 800 in preparation for play. The loading process can comprise retrieving data associated with the musical track from non-volatile memory, such as from a game disc or from a server over a wireless or wired network, and storing the data into quick-access memory, such as Random Access Memory (RAM). The musical track can include at least one fill section 706, as illustrated in FIG. 7.

At step 804, process 800 can identify metadata associated with one or more of the fill sections 706 associated with the musical track. The metadata can be embedded in the musical track or can be supplied from a separate file or data source from the data track. The metadata associated with the musical track can include metadata parameters useful for selecting pre-authored drum fills. For example, each musical track can include an indication of the song's style (e.g., Rock, Jazz, Country, or Blues), the song's tempo (e.g., Fast tempo, Medium tempo or Slow tempo), the song's beat type (e.g., triplets, swung, straight), and the song's difficulty level (e.g., Easy, Medium, Hard, Expert). In some embodiments, each musical track can have only one set of metadata parameters that remains constant for the entire track. In other embodiments, musical tracks can switch parameters partway through the song, e.g., a song that starts out as a Fast Rock song with a straight beat and a Hard difficulty can switch midway through into a Slow Blues song with a swung beat and a Medium difficulty. The metadata parameters included in the musical track can also include the number, location in time, and duration of fill sections 706.

At step 806, process 800 can select pre-authored drum fills out of drum fill database 750 to fill each fill section 706. Pre-authored drum fills can be selected according to any of the parameters discussed above in relation to FIG. 7. For example, if a certain fill section 706 calls for a fill with a Country Style, a Fast tempo, a triplets-based beat type, and an Expert difficulty level that lasts for 2 bars, process 800 can look for pre-authored drum fills that fit those parameters within drum fill database 750. If more than one pre-authored drum fill fits those parameters, process 800 can be configured to randomly select one of those drum fills. In other embodiments, if more than one pre-authored drum fill fits those parameters, process 800 can select a suitable drum fill without replacement, meaning that that drum fill can no longer be used for other fill sections within the same song. In yet other embodiments, if more than one pre-authored drum fill fits those parameters, process 800 can select a suitable drum fill by choosing drum fills in sequential order. Drum fill database 750 can be configured to store a large and diverse set of drum fills such that no matter what combination of parameters is required for a fill section 706, the process 800 will always have multiple candidate fills to choose from. This can help ensure that the drum fill section will likely be filled with a different drum fill every time the song is played.

In some cases, process 800 can determine that there is no suitable drum fill that matches every criteria requested by the metadata associated with a particular fill section 706. In those cases, process 800 can select the next best drum fill according to various policies For example, certain metadata parameters (e.g., tempo) can be prioritized over other parameters (e.g., style) such that drum fills that match only preferred parameters are selected over drum fills that match only non-preferred parameters. Values within parameters can also be prioritized so that process 800 can select the next best drum fill if the ideal drum fill is not available. For example: if a "hard" difficulty drum fill that matches all other criteria is not available, process 800 can select a "medium" difficulty drum fill or an "easy" difficulty drum fill, but can be configured to prefer a "medium" difficulty drum fill if one is available. Alternatively, if a "fast" tempo drum fill that matches all other criteria is not available, process 800 can select a "medium" tempo drum fill or a "slow" tempo drum fill, but can be configured to prefer a "medium" tempo drum fill if one is available. In some embodiments, process 800 can use known optimization algorithms that assign pre-specified weights to different parameters (both across multiple types of parameters, such as style, tempo, beat type, and difficulty level, as well as across parameters within a single type of parameter, such as fast, medium or slow within the parameter type "tempo") to determine the "best" drum fill for a particular fill section 706.

At step 808, which can be performed only if necessary, process 800 can truncate one or more drum fills to fit within a fill section 706. This can be necessary if the length of fill section 706 is slightly different from the length of available drum fills. For example, fill section 706 can last for 2 beats starting from beat 3 of a 4-beat measure, but the shortest pre-authored drum fill available from drum fill database 750 can last for one 4-beat measure. In these embodiments, process 800 can dynamically truncate a pre-authored drum fill to fit within the required length of the fill section. Continuing with the previous example, process 800 can be configured to select a pre-authored drum fill that lasts for one 4-beat measure, but use only the portion of the fill that correspond to beats 3 and 4 (i.e., the last 2 beats starting from beat 4).

At step 810, the process 800 can start playing the musical track 701. For the sections of the musical track that do not correspond to a fill section, the process 800 can display default drum cues.

At step 812, when process 800 reaches the portions of the musical track 701 that correspond to a fill section 706, process 800 can implement the pre-authored drum fill that was selected for that fill section in step 804. Specifically, process 800 can display the visual cues associated with the selected pre-authored drum fill. These visual cues associated with the selected pre-authored drum fill can appear similar to but visually distinguishable from regular cues, e.g., they can glow, exhibit a different color, appear larger or smaller, appear brighter or dimmer, etc. If the player provides the correct input at substantially the right times according to the displayed visual cues during a pre-authored drum fill, process 800 can play the relevant portions of the soundtrack associated with the selected pre-authored drum fill. If, however, the player does not provide the correct input at substantially the right times, process 800 can mute or distort (e.g., play at half-strength, muffle, or play a "wrong note" sound) the soundtrack associated with the selected pre-authored drum fill.

In some embodiments, the soundtrack associated with each drum fill can comprise data indicating the timing and type of expected input (e.g., input pads 202*a*, 202*b*, 202*c*, 202*d*, and foot pedal 230) associated with each note in the drum fill. However, the same drum fill can be synthesized into audible sound using different synthesizer settings. Synthesizer settings can include different mappings of input pads 202*a*, 202*b*, 202*c*, and 202*d* to different types of drums (e.g., snare, tom toms, high hats, bass kick), as well as different ways of synthesizing drum sounds (e.g., a high-pitched tom tom vs. a low-pitched tom tom sound, or snare drums with different types or number of snares). When playing sounds associated with the pre-authored drum fills, synthesizer settings can be varied depending (i) on the musical-track 701 (e.g., use setting 1 for musical-track 701, and setting 2 for another musical-track) or (ii) on the position the current fill section occupies within musical-track 701 (e.g., use setting 1 for the first fill section in musical-track 701, and setting 2 for a second fill section within musical-track 701). In some embodiments, drum fill database 750 can also store one or more preferred synthesizer settings for each drum fill. In these embodiments, synthesizer settings can be another criteria used to associate a drum fill with a fill section 706. For example, metadata associated with a fill section 706 can indicate which types of synthesizer settings are suitable for this fill section, and only drum fills that meet those synthesizer settings in drum fill database 750 can be selected for that fill section 706.

Successful, or partially successful completion of a selected pre-authored drum fill can lead to a bonus activation. In some embodiments, completing at least some of the indicated visual cues correctly can cause a "finale" gem to appear at the end of the selected pre-authored drum fill. Successful execution of the "finale" gem can lead to a bonus activation. Examples of bonus and accompanying in-game effects were discussed previously in relation to FIG. 1.

The above figures and discussion has focused on an improvisational or "fill" feature implemented using a drum controller. However, other embodiments featuring improvisational or "fill" features using other types of simulated instrument controllers are also possible. For example, a simulated guitar controller could be substituted for simulated drum controller 200, and cues associated with a simulated guitar controller could be displayed in place of cues for a drum controller. Drum fill database 750 could be substituted or augmented to include "guitar fills" instead of "drum fills" to create a guitar fill database. Such a guitar fill database could also store different guitar fills having different associated soundtracks and sets of visual cues, and each guitar fill could have associated with it similar characterizing parameters to those discussed above, including length, style, tempo, beat type, and difficulty. In addition to these parameters, guitar fills can also be associated with parameters specific to guitars, such as pitch (high-pitched vs. low-pitched), distortion (e.g., wail, feedback, screeching) or guitar-specific playing techniques such as hammer-ons, pull-offs, and tapping. Selections of guitar fills to fit specific fill sections can also be based on any or all of these parameters. Synthesizer settings for synthesizing guitar sounds can also be varied depending on the musical track or current position within a musical track. For example, the rhythm-action game's synthesizer could synthesize different types of electric guitars, and/or different types of acoustic guitars.

Figure 9:
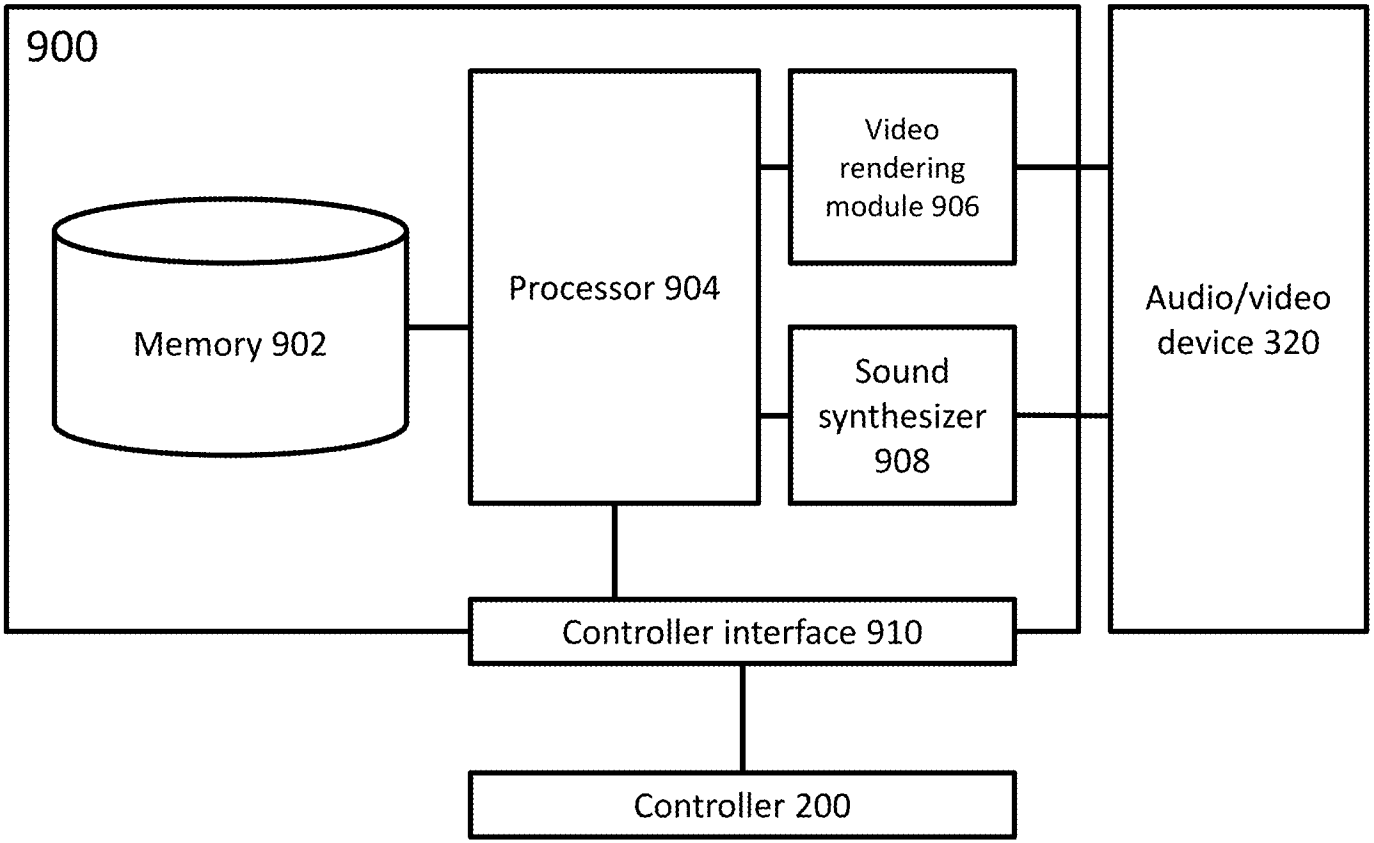
FIG. 9 is a block diagram illustrating in greater detail an exemplary apparatus for implementing a rhythm-action game with the above-described improvisational fill features.

FIG. 9 is a block diagram illustrating in greater detail an exemplary apparatus 900 for implementing a rhythm-action game with the above-described improvisation fill features. In some embodiments, apparatus 900 can be a dedicated game console, e.g., PLAYSTATION®3, PLAYSTATION®4, or PLAYSTATION®VITA manufactured by Sony Computer Entertainment, Inc.; WII™, WIT U™, NINTENDO 2DS™, or NINTENDO 3DS™ manufactured by Nintendo Co., Ltd.; or XBOX®, XBOX 360®, or XBOX ONE® manufactured by Microsoft Corp. In other embodiments, apparatus 900 can be a general purpose desktop or laptop computer. In other embodiments, apparatus 900 can be a server connected to a computer network. In yet other embodiments, apparatus 900 can be a mobile device (e.g., iPhone, iPad, tablet, etc.). Apparatus 900 can include a memory 902, processor 904, video rendering module 906, sound synthesizer 908, and a controller interface 910. The controller interface can be used to couple apparatus 900 with a controller 200, whereas video rendering module 906 and sound synthesizer 908 can connect to an audio/video device 320.

Memory 902 can include drum fill database 750, as well as musical track data that comprises pre-authored notes and cues corresponding to a particular song (e.g., musical-track 701). Memory 902 can also include machine-readable instructions for execution on processor 904. Memory can take the form of volatile memory, such as Random Access Memory (RAM) or cache memory. Alternatively, memory can take the form of non-volatile memory, including by way of example semiconductor memory devices, e.g., EPROM, EEPROM, and flash memory devices; magnetic disks, e.g., internal hard disks or removable disks. In some embodiments, memory 902 can be configured to retrieve and store musical track data from portable data storage devices, including magneto-optical disks, and CD-ROM and DVD-ROM disks. In other embodiments, memory 902 can be configured to retrieve and store musical track data over a network via a network interface (not shown).

Processor 904 can take the form of a programmable microprocessor executing machine-readable instructions. Alternatively, processor 904 can be implemented at least in part by special purpose logic circuitry, e.g., an FPGA (field programmable gate array) or an ASIC (application-specific integrated circuit) or other specialized circuit. Processor 904 can be configured to execute the steps in process 800, described above in relation to FIG. 8. Alternatively, processor 904 can be configured to execute only some of the steps in process 800, and other components can execute the remaining steps; for example, memory 902 can be configured to at least partly execute step 802 (load musical track data), and video rendering module 906 can be configured to at least partly execute step 808 (display selected pre-authored drum fills).

Processor 904 can be coupled with controller interface 910, which can be any interface configured to be coupled with an external controller. As depicted in FIG. 9, controller interface 910 can in turn be coupled with an external controller 200. As described above in relation to FIG. 2, external controller 200 can take the form of a simulated drum set comprising a number of drum pads 202, a controller 210, and a foot pedal 230.

Processor 904 can also be coupled to video rendering module 906 and sound synthesizer 908. While both modules are depicted as separate hardware modules outside of processor 904 (e.g., as stand-alone graphics cards or sound cards), other embodiments are also possible. For example, one or both modules can be implemented as specialized hardware blocks within processor 904. Alternatively, one or both modules can be implemented purely as software running within processor 904. Video rendering module 906 can be configured to generate a video display based on instructions from processor 904, while sound synthesizer 908 can be configured to generate sounds accompanying the video display. Video rendering module 906 and sound synthesizer 908 can be coupled to an audio/video device 320, which can be a TV, monitor, or other type of device capable of displaying video and accompanying audio sounds. While FIG. 9 shows two separate connections into audio/video device 320, other embodiments in which the two connections are combined into a single connection are also possible.

The above-described techniques can be implemented in digital electronic circuitry, or in computer hardware, firmware, software, or in combinations of them. The implementation can be as a computerized method or process, or a computer program product, i.e., a computer program tangibly embodied in a machine-readable storage device, for execution by, or to control the operation of, data processing apparatus, e.g., a programmable processor, a computer, a game console, or multiple computers or game consoles. A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or game console or on multiple computers or game consoles at one site or distributed across multiple sites and interconnected by a communication network.

Method steps (such as method steps in process 900) can be performed by one or more programmable processors executing a computer or game program to perform functions of the invention by operating on input data and generating output. Method steps can also be performed by, and apparatus can be implemented as a game platform such as a dedicated game console, e.g., PLAYSTATION®3, PLAYSTATION®4, or PLAYSTATION®VITA manufactured by Sony Computer Entertainment, Inc.; WII™, WIT U™, NINTENDO 2DS™, or NINTENDO 3DS™ manufactured by Nintendo Co., Ltd.; or XBOX®, XBOX 360®, or XBOX ONE® manufactured by Microsoft Corp.; or special purpose logic circuitry, e.g., an FPGA (field programmable gate array) or an ASIC (application-specific integrated circuit) or other specialized circuit. Modules can refer to portions of the computer or game program or gamer console and/or the processor/special circuitry that implements that functionality.

Processors suitable for the execution of a computer program include, by way of example, both general and special purpose microprocessors, and any one or more processors of any kind of digital computer or game console. Generally, a processor receives instructions and data from a read-only memory or a random access memory or both. The essential elements of a computer or game console are a processor for executing instructions and one or more memory devices for storing instructions and data. Generally, a computer also includes, or is operatively coupled, to receive data from or transfer data to, or both, one or more mass storage devices for storing data, e.g., magnetic, magneto-optical disks, or optical disks. Data transmission and instructions can also occur over a communications network. Information carriers suitable for embodying computer program instructions and data include all forms of non-volatile memory, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in special purpose logic circuitry.

To provide for interaction with a player, the above described techniques can be implemented on a computer or game console having a display device, e.g., a CRT (cathode ray tube) or LCD (liquid crystal display) monitor, a television, or an integrated display, e.g., the display of a PLAYSTATION®VITA or Nintendo 3DS. The display can in some instances also be an input device such as a touch screen. Other typical inputs include simulated instruments, microphones, or game controllers. Alternatively, input can be provided by a keyboard and a pointing device, e.g., a mouse or a trackball, by which the player can provide input to the computer or game console. Other kinds of devices can be used to provide for interaction with a player as well; for example, feedback provided to the player can be any form of sensory feedback, e.g., visual feedback, auditory feedback, or tactile feedback; and input from the player can be received in any form, including acoustic, speech, or tactile input.

The above described techniques can be implemented in a distributed computing system that includes a back-end component, e.g., as a data server, and/or a middleware component, e.g., an application server, and/or a front-end component, e.g., a client computer or game console having a graphical player interface through which a player can interact with an example implementation, or any combination of such back-end, middleware, or front-end components. The components of the system can be interconnected by any form or medium of digital data communication, e.g., a communication network. Examples of communication networks include a local area network ("LAN") and a wide area network ("WAN"), e.g., the Internet, and include both wired and wireless networks.

The computing/gaming system can include clients and servers or hosts. A client and server (or host) are generally remote from each other and typically interact through a communication network. The relationship of client and server arises by virtue of computer programs running on the respective computers and having a client-server relationship to each other.

The invention has been described in terms of particular embodiments. The alternatives described herein are examples for illustration only and not to limit the alternatives in any way. The steps of the invention can be performed in a different order and still achieve desirable results.

The invention claimed is:

1. A method for varying a play experience of a player of a rhythm-action game, the method being executed by a computing device comprising at least one processor and at least one memory in communication with the at least one processor, the method comprising:

storing in the at least one memory:

a musical track, the musical track having at least one variable fill section, and a database having a plurality of fills for the at least one variable fill section, each fill being associated with a different set of cues, wherein each cue directs the player to provide an input; and for each variable fill section of the at least one variable fill section in the musical track:

(i) selecting, for a playthrough of the musical track, by the at least one processor, a fill from the plurality of fills in the database;

(ii) transmitting display data to a display in communication with the at least one processor, the display data comprising at least part of the set of cues associated with the selected fill; and (iii) for each displayed cue:

(a) receiving player input;

(b) evaluating whether the received player input corresponds to the input directed by the displayed cue; and (c) altering an aspect of gameplay based on the evaluation.

2. The method of claim 1, wherein:

each cue directs the player to provide an input corresponding to a drum pad of a plurality of drum pads on a drum controller;

receiving player input comprises receiving input from the drum controller indicating which drum pad on the drum controller has been activated; and evaluating whether the received player input corresponds to the input directed by the displayed cue comprises evaluating whether the activated drum pad corresponds to the drum pad directed by the displayed cue.

3. The method of claim 1, wherein:

each fill of the plurality of fills in the database is further associated with a different soundtrack; and altering an aspect of gameplay based on the evaluation comprises:

when the received user input corresponds to the input directed by the displayed cue, playing at least a portion of the soundtrack associated with the fill that is associated with the set of cues of which the displayed cue is a part, and when the received user input does not correspond to the input directed by the displayed cue, playing at least one of a muffled, muted, or distorted version of the soundtrack associated with the fill that is associated with the set of cues of which the displayed cue is a part.

4. The method of claim 3, wherein:

each soundtrack associated with each fill of the plurality of fills can be played according to a plurality of synthesizer settings; and playing at least a portion of the soundtrack when the received user input corresponds to the input directed by the displayed cue comprises:

selecting a synthesizer setting, and playing the at least a portion of the soundtrack using the selected synthesizer setting.

5. The method of claim 4, wherein the selection of the synthesizer setting is based at least in part on at least one characterizing parameter associated with at least one of the musical track, a variable fill section of the musical track, and a fill section selected by the at least one processor.

6. The method of claim 1, wherein the playthrough is a first playthrough, the method further comprising:

for each variable fill section of the at least one variable fill section in the musical track:

selecting, for a second playthrough of the musical track, by the at least one processor, a fill from the plurality of fills in the database, wherein, for at least some of the at least one variable fill section in the musical track, the fill selected by the at least one processor for the first playthrough is different from the fill selected by the at least one processor for the second playthrough.

7. The method of claim 1, wherein:

each fill of the plurality of fills in the database is further associated with a set of characterizing parameters; and for each variable fill section of the at least one variable fill section in the musical track, the selection of the fill from the plurality of fills is based at least in part on the set of characterizing parameters.

8. The method of claim 7, wherein the set of characterizing parameters includes at least one of a fill length, a style, a tempo, a beat type, and a difficulty level.

9. The method of claim 7, wherein, for each variable fill section of the at least one variable fill section in the musical track, the selection of the fill from the plurality of fills is further based on one or more characterizing parameters associated with the musical track.

10. The method of claim 7, wherein, for a particular variable fill section of the at least one variable fill section in the musical track, the selection of the fill from the plurality of fills is further based on one or more characterizing parameters associated with the particular variable fill section.

11. A computer system for varying a play experience of a player of a rhythm-action game, the computer system comprising:

a memory that stores:

a musical track, the musical track having at least one variable fill section, and a database having a plurality of fills for the at least one variable fill section, each fill being associated with a different set of cues, wherein each cue directs the player to provide an input; and at least one processor configured to, for each variable fill section of the at least one variable fill section in the musical track:

(i) select, for a playthrough of the musical track a fill from the plurality of fills in the database;

(ii) transmit display data to a display, the display data comprising at least part of the set of cues associated with the selected fill; and (iii) for each displayed cue:

(a) receive player input;

(b) evaluate whether the received player input corresponds to the input directed by the displayed cue; and (c) alter an aspect of gameplay based on the evaluation.

12. The system of claim 11, wherein:

each cue directs the player to provide an input corresponding to a drum pad of a plurality of drum pads on a drum controller;

the at least one processor is further configured to:

receive player input by receiving input from the drum controller indicating which drum pad on the drum controller has been activated; and evaluate whether the received player input corresponds to the input directed by the displayed cue by evaluating whether the activated drum pad corresponds to the drum pad directed by the displayed cue.

13. The system of claim 11, wherein:

each fill of the plurality of fills in the database is further associated with a different soundtrack; and the at least one processor is further configured to alter an aspect of gameplay based on the evaluation by:

when the received user input corresponds to the input directed by the displayed cue, playing at least a portion of the soundtrack associated with the fill that is associated with the set of cues of which the displayed cue is a part, and when the received user input does not correspond to the input directed by the displayed cue, playing at least one of a muffled, muted, or distorted version of the soundtrack associated with the fill that is associated with the set of cues of which the displayed cue is a part.

14. The system of claim 13, wherein:

each soundtrack associated with each fill of the plurality of fills can be played according to a plurality of synthesizer settings; and the at least one processor is further configured to play at least a portion of the soundtrack when the received user input corresponds to the input directed by the displayed cue by:

selecting a synthesizer setting, and playing the at least a portion of the soundtrack using the selected synthesizer setting.

15. The system of claim 14, wherein the selection of the synthesizer setting is based at least in part on at least one characterizing parameter associated with at least one of the musical track, a variable fill section of the musical track, and a fill section selected by the processor.

16. The system of claim 11, wherein the playthrough is a first playthrough, and wherein the at least one processor is further configured to:

for each variable fill section of the at least one variable fill section in the musical track:

select, for a second playthrough of the musical track a fill from the plurality of fills in the database, wherein, for at least some of the at least one variable fill section in the musical track, the fill selected by processor for the first playthrough is different from the fill selected by the processor for the second playthrough.

17. The system of claim 11, wherein:

each fill of the plurality of fills in the database is further associated with a set of characterizing parameters; and for each variable fill section of the at least one variable fill section in the musical track, the selection of the fill from the plurality of fills is based at least in part on the set of characterizing parameters.

18. The system of claim 17, wherein the set of characterizing parameters includes at least one of a fill length, a style, a tempo, a beat type, and a difficulty level.

19. The system of claim 17, wherein, for each variable fill section of the at least one variable fill section in the musical track, the selection of the fill from the plurality of fills is further based on one or more characterizing parameters associated with the musical track.

20. The system of claim 17, wherein, for a particular variable fill section of the at least one variable fill section in the musical track, the selection of the fill from the plurality of fills is further based on one or more characterizing parameters associated with the particular variable fill section.

21. Non-transitory computer readable media storing machine-readable instructions that are configured to, when executed by at least one processor, cause the at least one processor to:

access from at least one memory:

a musical track, the musical track having at least one variable fill section, and a database having a plurality of fills for the at least one variable fill section, each fill being associated with a different set of cues, wherein each cue directs the player to provide an input; and for each variable fill section of the at least one variable fill section in the musical track:

(i) select, for a playthrough of the musical track, a fill from the plurality of fills in the database;

(ii) transmit display data to a display, the display data comprising at least part of the set of cues associated with the selected fill; and (iii) for each displayed cue:

(a) receive player input;

(b) evaluate whether the received player input corresponds to the input directed by the displayed cue; and (c) alter an aspect of gameplay based on the evaluation.

* * * * *